US009420842B2

(12) United States Patent
Witcher

(10) Patent No.: US 9,420,842 B2
(45) **Date of Patent: *Aug. 23, 2016**

(54) PROTECTIVE HELMET

(71) Applicant: Michcar Partners, LLC, Bingham Farms, MI (US)

(72) Inventor: David L. Witcher, Oak Island, NC (US)

(73) Assignee: MICHCAR PARTNERS, LLC, Bingham Farms, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/833,448

(22) Filed: Aug. 24, 2015

(65) Prior Publication Data

US 2015/0359287 A1 Dec. 17, 2015

Related U.S. Application Data

(63) Continuation of application No. 13/721,186, filed on Dec. 20, 2012, now Pat. No. 9,113,672.

(60) Provisional application No. 61/631,549, filed on Jan. 6, 2012.

(51) Int. Cl.
*A42B 3/12* (2006.01)

(52) U.S. Cl.
CPC ..... *A42B 3/122* (2013.01); *A42B 3/121* (2013.01)

(58) Field of Classification Search
CPC ..... A42B 3/04; A42B 3/06; A42B 3/0486; A42B 3/064; A42B 3/065; A42B 3/10; A42B 3/12; A42B 3/121; A42B 3/124; A42B 3/125; A42B 3/128
USPC ..... 2/410–414
See application file for complete search history.

(56) References Cited

U.S. PATENT DOCUMENTS

| | | | | | |
|---|---|---|---|---|---|
| 3,039,109 | A * | 6/1962 | Simpson | A42B 3/121 | 2/413 |
| 3,872,511 | A * | 3/1975 | Nichols | A42B 3/121 | 2/413 |
| 3,999,220 | A * | 12/1976 | Keltner | A42B 3/065 | 2/23 |
| 4,354,284 | A | 10/1982 | Gooding | | |
| 4,586,200 | A * | 5/1986 | Poon | A42B 3/122 | 2/413 |
| 5,129,107 | A * | 7/1992 | Lorenzo | A42B 1/203 | 2/413 |

(Continued)

FOREIGN PATENT DOCUMENTS

| | | | |
|---|---|---|---|
| CN | CN101227842 | A | 7/2008 |
| CN | CN101707885 | A | 5/2010 |
| EP | 0222029 | A1 | 5/1987 |

OTHER PUBLICATIONS

International Search Report dated Apr. 26, 2013 from corresponding International Application Serial No. PCT/US2012/071243.

(Continued)

*Primary Examiner* — Gloria Hale
(74) *Attorney, Agent, or Firm* — Dickinson Wright PLLC

(57) ABSTRACT

A protective helmet includes an outer shell and a controlled air dissipation (CAD) assembly installed within the outer shell. The CAD assembly includes an inner shell liner releasably mounted to the outer shell, a primary bellows unit disposed between an outer surface of the inner shell liner and the inside surface of the outer shell, and a secondary bellows unit disposed between an inner surface of the inner shell liner and the head of a person wearing the protective helmet.

18 Claims, 16 Drawing Sheets

(56) References Cited

U.S. PATENT DOCUMENTS

| | | | | |
|---|---|---|---|---|
| 5,204,998 | A * | 4/1993 | Liu | A42B 3/121 2/411 |
| 5,324,460 | A | 6/1994 | Briggs | |
| 6,073,271 | A | 6/2000 | Alexander et al. | |
| 6,591,428 | B2 | 7/2003 | Halstead et al. | |
| 7,299,505 | B2 | 11/2007 | Dennis et al. | |
| 7,676,854 | B2 | 3/2010 | Berger et al. | |
| 8,844,066 | B1 * | 9/2014 | Whitcomb | A42B 3/121 2/413 |
| 2006/0059606 | A1 * | 3/2006 | Ferrara | A01N 25/18 2/412 |
| 2007/0190293 | A1 * | 8/2007 | Ferrara | B29C 45/0053 428/166 |
| 2013/0000017 | A1 | 1/2013 | Szalkowski et al. | |
| 2013/0014313 | A1 | 1/2013 | Erb et al. | |
| 2013/0152286 | A1 * | 6/2013 | Cormier | A41D 13/0156 2/459 |
| 2013/0174331 | A1 * | 7/2013 | Witcher | A42B 3/121 2/413 |
| 2014/0123371 | A1 * | 5/2014 | Witcher | A42B 3/121 2/413 |

OTHER PUBLICATIONS

Search Report dated Nov. 15, 2015 from corresponding Chinese Patent Application Serial No. 201280071208.1.

* cited by examiner

PROTECTIVE HELMET

CROSS-REFERENCE TO RELATED APPLICATIONS

This application is a continuation of U.S. Ser. No. 13/721,186 filed Dec. 20, 2015, now U.S. Pat. No. 9,113,672, which claims priority to and the benefit of U.S. Provisional Application No. 61/631,549 filed on Jan. 6, 2012. The entire disclosure of each of the above applications is incorporated herein by reference.

FIELD

The present disclosure relates generally to a protective helmet and, more particularly to a protective helmet comprised of an outer shell and a controlled air dissipation assembly that can be installed within the outer shell.

BACKGROUND

This section provides background information related to the present disclosure which is not necessarily prior art.

Protective helmets are used in a variety of sporting and racing activities, in addition to military duty, to assist in protecting the wearer's head from impact related injuries. Such protective helmets are most commonly used in sporting activities such as, for example without limitation, football, hockey, lacrosse, cycling and baseball. Likewise, protective helmets are used in both on-road and off-road racing activities such as, for example without limitation, stock car and open-wheel racing, drag-racing, motorcycle racing, moto-cross racing and go-cart racing.

A primary function of protective helmets is to protect the wearer from head injuries associated with high impact forces that may be sustained during the above-noted sporting and racing activities. Conventional protective helmets consist of a rigid outer shell and an impact damping or cushioning assembly disposed between the outer shell and the wearer's head. Many known damping assemblies utilize a compressible material to absorb and dissipate the impact force. Typically, such compressible materials have included pressurized air, viscous gel-like mediums, foam or a combination thereof.

While such conventional protective helmets perform satisfactorily for their intended purpose, recent awareness regarding the detrimental long-term effects that head impacts may have on athletes, particularly football and hockey players, has led to a need for continued development of improved impact damping technology. Accordingly, there is a recognized need in the art to design and develop alternative technologies that advance the protection afforded to those wearing a protective helmet.

SUMMARY

This section provides a general summary of the disclosure, and is not a comprehensive disclosure of its full scope or all of its features.

In accordance with one aspect of the present disclosure, a protective helmet is disclosed which incorporates an energy dissipation system for dissipating the energy associated with an impact force applied to the protective helmet and embodying a unique and non-obvious dual-stage air dissipation technology.

In accordance with a related aspect of the present disclosure, the protective helmet includes an outer shell and a controlled air dissipation ("CAD") assembly installed within the outer shell and which utilizes the dual-stage air dissipation technology.

In accordance with these and other aspect, features and objects, the present disclosure relates to a protective helmet having the CAD assembly removeably installed in the interior cavity of the outer shell. The CAD assembly includes a primary or outer bellows unit, a secondary or inner bellows unit, and an inner shell liner disposed between the primary and secondary bellows units. The primary bellows unit is secured in a sealed air-tight manner to an outer surface of the inner shell liner. The primary bellows unit includes a plurality of primary bellows chambers which are interconnected by primary air bridge channels to facilitate the transfer of air between adjacent primary bellows chambers. The primary bellows chambers are defined between the outer surface of the inner shell liner and a series of interconnected first stage air-filled pad sections. The first stage pad sections are adapted to engage an inner surface of the outer shell. A primary air charge hole extends through each of the first stage pad sections to permit ambient air to be in fluid communication with the corresponding primary bellows chamber. The secondary bellows unit is secured in a sealed air-tight manner to an inner surface of the inner shell liner. The secondary bellows unit includes a plurality of secondary bellows chambers which are interconnected by secondary air bridge channels to facilitate the transfer of air between adjacent secondary bellow chambers. The secondary bellow chambers are defined between the inner surface of the inner shell liner and a series of interconnected second stage air-filled pad sections. The second stage pad sections are adapted to engage the head of a person wearing the protective helmet. A secondary air charge hole extends through each of the second stage pad sections to permit ambient air to be in fluid communication with the corresponding secondary bellows chamber. Air transfer holes extending through the inner shell liner facilitate the transfer of air between corresponding pairs of primary and secondary bellow chambers.

In accordance with one exemplary embodiment of the CAD assembly, the primary bellows chambers and the secondary bellows chambers associated with the primary and secondary bellows units are configured in a substantially mirror-image arrangement such that each primary bellows chamber is in fluid communication with a similarly configured secondary bellows chamber via the air transfer hole formed through the inner shell liner.

In accordance with another exemplary embodiment of the CAD assembly, the inner shell liner includes front and rear mounting flanges for releasably mounting the CAD assembly to the outer shell of the protective helmet. In addition, baffle projections are formed within the primary and secondary bellows chambers to facilitate directional flow of air therein during an air transfer event caused by resilient deflection of the first stage pad sections and/or the second stage pad sections in response to an impact force being imparted on the outer shell of the protective helmet.

In accordance with another exemplary embodiment of the CAD system, the primary bellows unit includes a plurality of interconnected primary bellows chambers configured and arranged to define at least one primary crown bellows chamber, at least one primary front bellows chamber, at least one primary rear bellows chamber, a plurality of primary side bellows chambers, and a pair of primary ear bellows chambers. The at least one primary crown bellows chamber defines a first stage crown pad section that is generally aligned with a crown region of the outer shell. The at least one primary front bellows chamber defines a first stage front pad section that is generally aligned with a frontal region of the outer shell. The at least one primary rear bellows chamber defines a first stage rear pad section that is generally aligned with an aft region of the outer shell. The plurality of primary side bellows chambers define a plurality of first stage side pad sections disposed below the first stage crown pad and between the first stage front and rear pad sections and which are generally aligned with side regions of the outer shell. Finally, the pair of primary ear bellows chambers define a pair of first stage ear pad sections disposed below the first stage side pad sections and which are generally aligned with an ear/jaw region of the outer shell.

In accordance with a related exemplary embodiment of the CAD assembly, the secondary bellows unit includes a plurality of interconnected secondary bellows chambers configured and arranged to define at least one secondary crown bellows chamber, at least one secondary front bellows chamber, at least one secondary rear bellows chamber, a plurality of secondary side bellows chambers, and a pair of secondary ear bellows chambers. The at least one secondary crown bellows chamber defines a second stage crown pad section that is generally aligned with a crown region of the helmet wearer's head. The at least one secondary front bellows chamber defines a second stage front pad section that is generally aligned with a front region of the helmet wearer's head. The at least one secondary rear bellows chamber defines a second stage rear pad section that is generally aligned with a rear region of the helmet wearer's head. The plurality of secondary side bellows chambers define a plurality of second stage side pad sections disposed below the second stage crown pad section and between the second stage front and rear pad sections and which are generally aligned with side regions of the helmet wearer's head. Finally, the pair of secondary ear bellows chambers define a pair of second stage ear pad sections disposed below the second stage side pad sections and which are generally aligned with an ear/jaw region of the helmet wearer's head.

In accordance with a still further related embodiment of the CAD assembly, the first stage pad sections associated with the primary bellows unit extend outwardly from the outer surface of the inner shell liner while the second stage pad sections associated with the secondary bellows unit extend inwardly from the inner surface of the inner shell liner. Air transfer holes extending through the inner shell liner facilitate the transfer of air between aligned sets of the bellows chambers associated with corresponding first stage pad sections and second stage pad sections.

In accordance with yet another exemplary embodiment of the CAD assembly, the first stage pad sections provide an initial cushion of air and function to dampen an impact applied to the outer shell by delaying the impact force from being transferred to the head of the wearer of the protective helmet. Specifically, collapse of the first stage pad sections upon the impact acts to forcibly transfer air between the interconnected primary bellows chambers so as to spread the impact force and dissipate the magnitude of the impact force transferred from the outer shell to the primary bellows unit. In addition, air is forcibly transferred through the air transfer holes into the secondary bellows chambers of the corresponding second stage pad sections. Subsequent collapse of the second stage pad sections upon engagement with the wearer's head acts to forcibly transfer air between the interconnected secondary bellows chambers. Air is then transferred from the secondary bellows chambers through the air charge holes and back into the primary bellows chambers, thereby continuously filling and refilling interconnected pairs of primary and secondary bellows chambers so as to disperse the impact forces around and out of the protective helmet.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
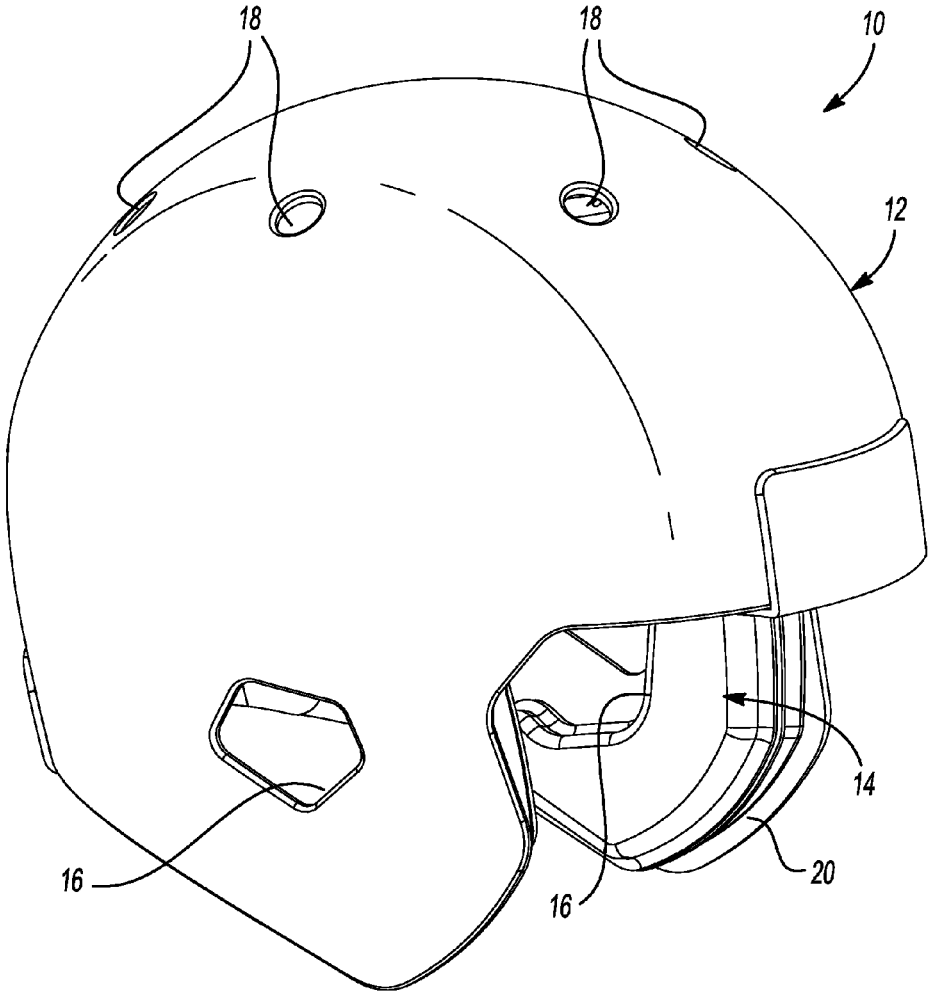
FIG. 1 is an isometric view of a protective helmet configured and constructed in accordance with the teachings of the present disclosure to include a rigid outer shell and a controlled air dissipation ("CAD") assembly attached within the outer shell.

Example embodiments will now be described more fully with reference to the accompanying drawings. However, the example embodiments are solely provided so that this disclosure will be thorough and fully convey the scope of the present disclosure to those who are skilled in the art. To this end, numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The present disclosure is generally directed to a protective helmet incorporating a novel and unobvious air transfer and metering technology, hereinafter referred to as "dual-stage air dissipation technology", for use in absorbing and/or transferring impact loads imparted onto the helmet's outer shell prior to transmission of such impact loads to the head of the helmet wearer. While a specific type of protective helmet is shown in the drawings, particularly a football helmet, those skilled in the art will appreciate and acknowledge that the dual-stage air dissipation technology of the present disclosure can be readily incorporated into any other types of protective helmets used by a wearer to provide head protection. To this end, it is contemplated that the teachings of the present disclosure are applicable to protective helmets used for other activities including, but not limited to, baseball, hockey, lacrosse, cycling, motor racing (i.e., on-road and off-road), moto-cross and motorcycles as well as for use in military applications.

Referring primarily to FIG. 1, a protective helmet 10 constructed in accordance with the teachings of the present disclosure is shown to generally include an outer shell 12 and a controlled air dissipation assembly, hereafter referred to as CAD assembly 14. Outer shell 12 is an otherwise conventional helmet configuration of the type commonly used as part of a football helmet and is shown to include ear holes 16 and a plurality of vent holes 18. Those skilled in the art will recognize that a face mask (not shown) can be secured to an open front portion of outer shell 12 in a known manner. Additionally, outer shell 12 can include snaps (not shown) to facilitate attachment of a chin strap thereto. While not specifically limited thereto, outer shell can be fabricated from a suitable rigid material, such as polycarbonate or ABS. As will be detailed, CAD assembly 14 is removeably secured within an inner cavity of outer shell 12 in proximity to an inner wall surface 20 thereof.

Figure 2:
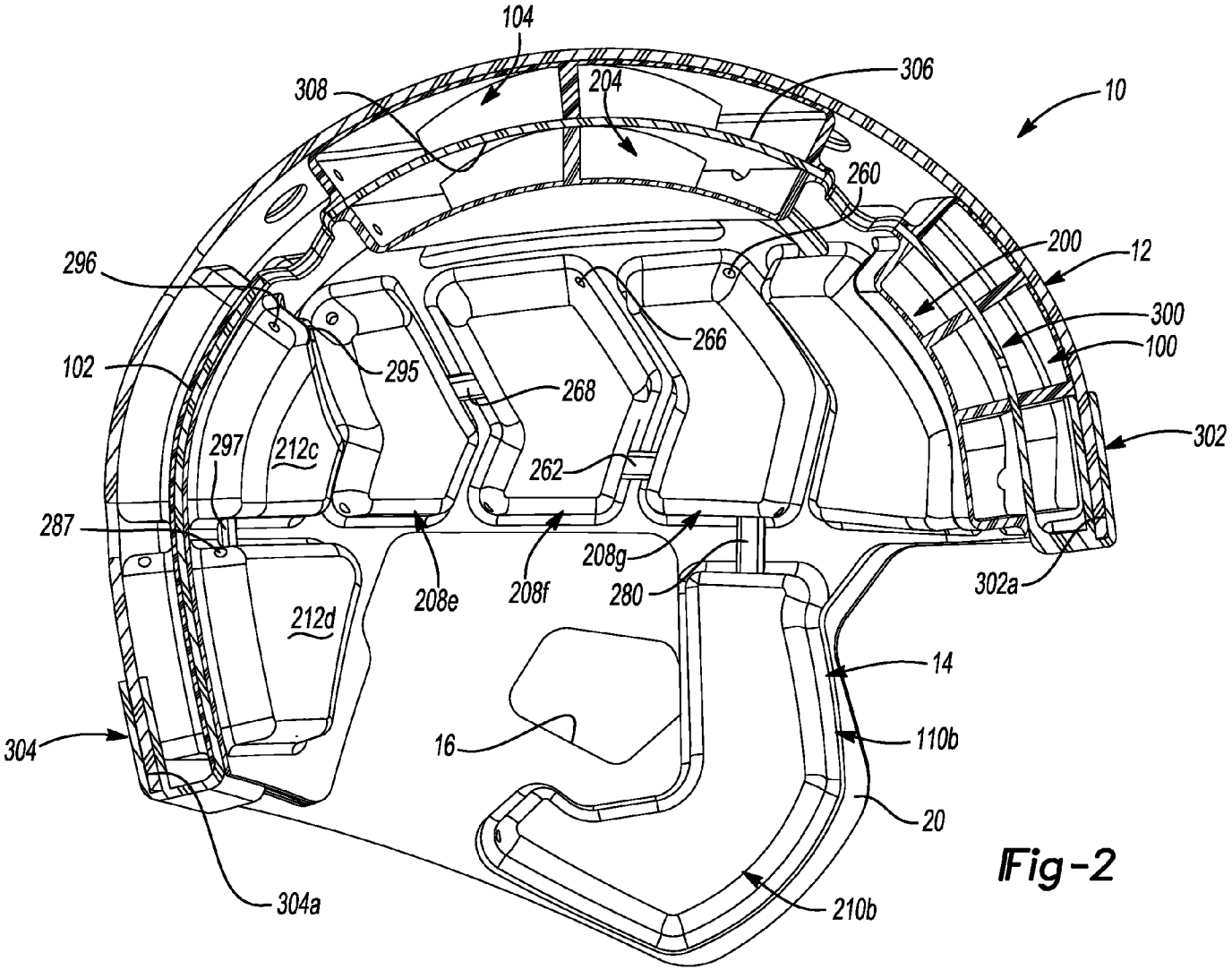
FIG. 2 is a sectional view of the protective helmet shown in FIG. 1 and which illustrates the mounting structure utilized to removeably attach the CAD assembly within the rigid outer shell.
Figure 3:
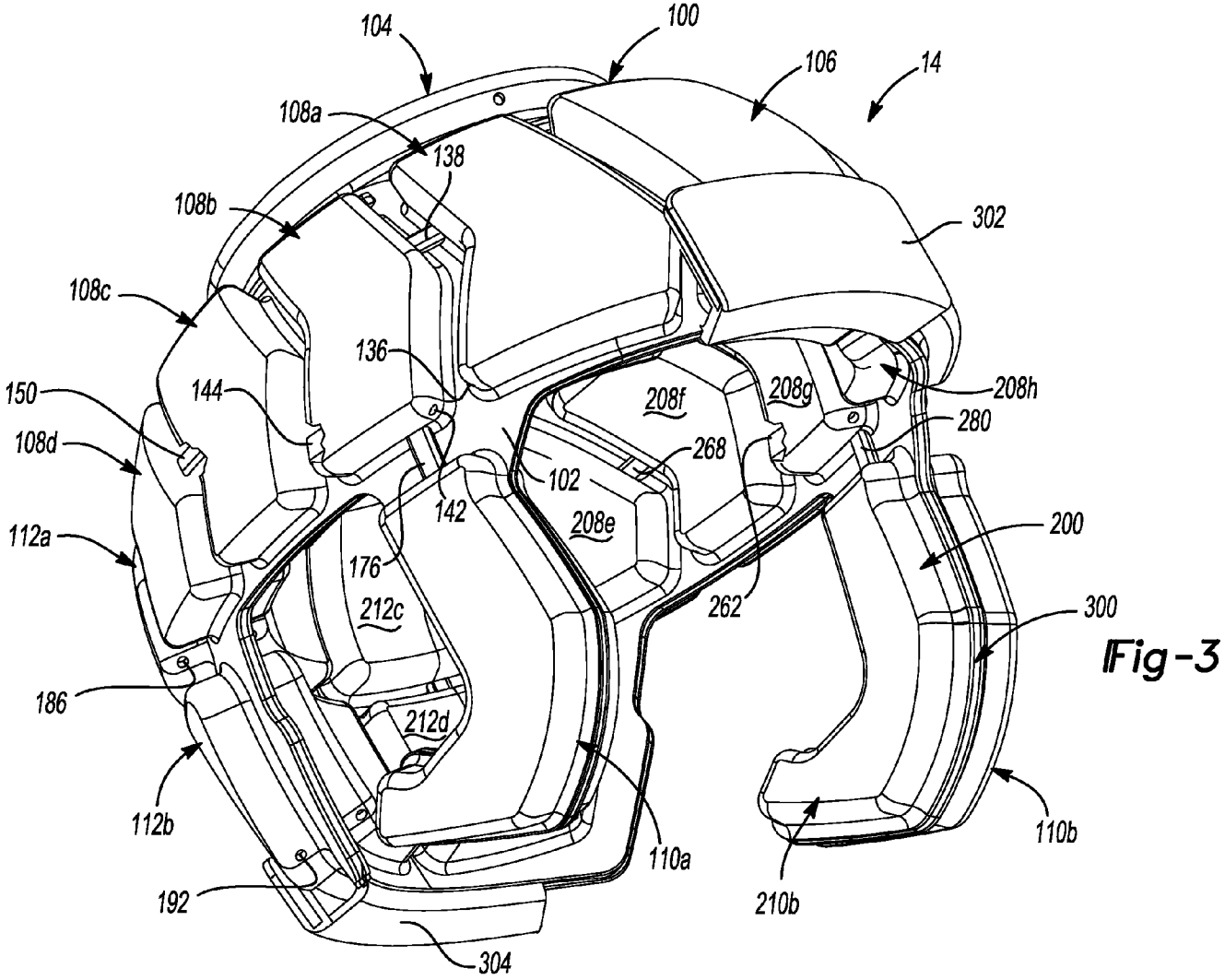
FIG. 3 is an isometric view of the CAD assembly removed from the outer shell of the protective helmet and showing the CAD assembly to include a primary bellows unit, a secondary bellows unit, and an inner shell liner disposed between the primary and secondary bellows units.

Referring now primarily to FIGS. 2 and 3, CAD assembly 14 is shown generally as a three component assembly comprised of an outer or primary bellows unit 100, an inner or secondary bellows unit 200, and an inner shell liner 300 that is disposed between primary bellows unit 100 and secondary bellows unit 200. Inner shell liner 300 is shown to include a front U-shaped mounting flange 302 and a rear U-shaped mounting flange 304, each having a corresponding mounting groove 302A, 304A that is sized to accept and retain front and rear portions of outer shell 12 therein. While not shown, fasteners can be used to secure mounting flanges 302 and 304 to outer shell 12. Based on this exemplary construction, CAD assembly 14 can be easily installed or removed from the internal cavity of outer shell 12 using the mounting structure associated with inner shell liner 300.

As will be detailed hereinafter with much greater specificity, primary bellows unit 100 includes a plurality of first stage pad sections each defining a primary bellows chamber that is in fluid communication with at least one other adjacent primary bellows chamber and which are each in communication with ambient air via primary air charge holes. An outer surface of the first stage pad sections is configured to engage, or be located in close proximity to, inner surface 20 of outer shell 12. Likewise, secondary bellows unit 200 includes a plurality of second stage pad sections each defining a secondary bellows chamber that is in fluid communication with at least one other adjacent secondary bellows chamber and which are each in communication with ambient air via secondary air charge holes. The second stage pad sections are configured to engage, or be in close proximity to, the head of a person wearing protective helmet 10. Inner shell liner 300 includes a plurality of air transfer holes that facilitate the transfer of air between corresponding sets of aligned primary and second bellows chambers. Accordingly, CAD assembly 14 is configured to define a dual stage air dissipation system which, upon an impact force being applied to outer shell 12, facilitates: A) the transfer of air between adjacent primary bellows chambers; B) the transfer of air between adjacent secondary bellows; and C) the transfer of air between aligned sets of primary and secondary bellows chambers.

In accordance with the dual stage air dissipation system, the above-noted transfer of ambient air is controlled and regulated to dissipate the impact forces applied to helmet 10. Upon the head of the helmet wearer encountering an impact, one or more of the first stage pad sections and, subsequently, one or more of the second stage pad sections are resiliently deflected to cause a regulated and controlled transfer of air between adjacent bellows chambers. This regulated air transfer is operable to react against the forces associated with the impact and create an air-cushioned energy dissipation process. This energy dissipation process is operable to spread the impact forces to a much larger area, thereby delaying the time between actual impact and the subsequent release of the energy created and ultimately transferred to the wearer's head.

Primary bellows unit 100 of CAD assembly 14 is generally shown to include a plurality of first stage pad sections extending outwardly from a primary base section 102 that, in turn, is secured in an air-tight manner to an outer surface 306 of inner shell liner 300. Since the first stage pad sections are normally filled with non-pressurized ambient air, they are configured to deflect in response to an impact load applied to outer shell 12. It is contemplated that primary bellows unit 100 can be a one-piece molded component formed from a suitably semi-rigid, yet resilient material. One suitable material may include TPU (Thermal Plastic Urethane), TPE (Thermal Polyester Elastollen) or a blended Thermal Elastomer.

The first stage pad sections can be grouped into distinct sections associated with base section 102. Specifically, the first stage pad sections may include at least one crown pad section 104, at least one front pad section 106, a plurality of peripheral side pad sections 108A-108H, a pair of ear pad sections 110A, 110B, and a plurality of rear pad sections 112A-112D. FIG. 3 illustrates the first stage pad sections mentioned above extending outwardly from primary base section 102. FIGS. 4 and 6 through 9 illustrate these first stage pad sections in a generally translucent manner to better define and show one or more internal baffle projections that are formed in each of the corresponding primary bellows chambers. The arrangement and function of such internal baffle projections will be described hereinafter in greater detail.

With primary reference to FIGS. 4 through 10, the specific construction and features associated with primary bellows unit 100 will now be described in more detail. Upon assembly of CAD assembly 14 into outer shell 12, crown pad section 104 will be located at a crown region of outer shell 12 and is generally configured to be arcuate and define a generally cylindrical primary crown bellows chamber 114. An inner surface of crown pad section 104 within primary crown bellows chamber 114 is shown to include a cross-shaped baffle projection 115 extending downwardly therefrom and which projects toward outer surface 306 of inner shell liner 300. Cross-shaped baffle projection 115 generally segregates primary crown bellows chamber 114 into quadrants and facilitates a radially outward and centrifugal air flow pattern therein. A pair of primary air charge holes 116 extend through crown pad section 104 to permit ambient air to communicate with front and back portions of primary crown bellows chamber 114.

A first primary air bridge channel 118 is shown to interconnect primary crown bellows chamber 114 for fluid communication with a primary side bellows chamber 120 associated with side pad section 108D while a second primary air bridge channel 122 is shown to interconnect primary crown bellows chamber 114 for fluid communication with a primary side bellows chamber 124 associated with side pad section 108H. Each of the primary air bridge channels described hereinafter is configured as a tubular passage extending outwardly from base section 102 between a pair of primary bellows chambers.

Figure 4:
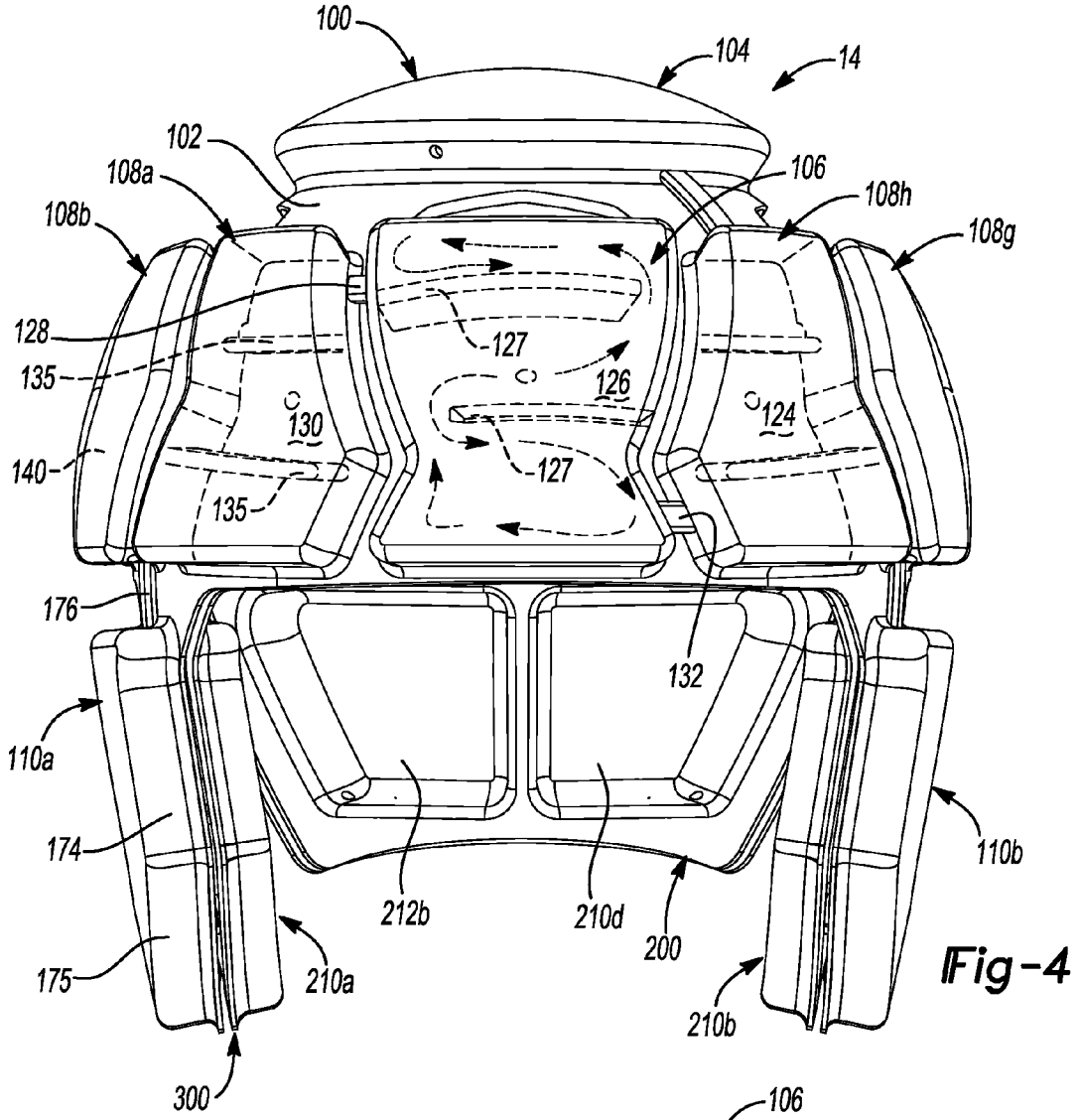
FIG. 4 is a frontal isometric view of the CAD assembly, with portions of the mounting structure associated with the inner shell liner removed for additional clarity.

Upon installation of CAD assembly 14 within outer shell 12, front pad section 106 of primary bellows unit 100 is oriented to be located at a forward region of outer shell 12 and defines a primary front bellows chamber 126. A plurality of elongated baffle projections 127 extend downwardly into primary front bellows chamber 126 to form a labyrinth type air flow pattern therein (FIG. 4). A third primary air bridge channel 128 is shown to provide fluid communication between primary front bellows chamber 126 and a primary side bellows chamber 130 associated with side pad section 108A. Likewise a fourth primary air bridge channel 132 provides fluid communication between primary front bellows chamber 126 and primary side bellows chamber 124 associated with side pad section 108H. A primary air charge hole 134 extends through front pad section 106 to permit ambient air to communicate with primary front bellows chamber 126.

As noted, side pad section 108A defines primary side bellows chamber 130. A pair of elongated baffle projections 135 extend downwardly into primary side bellows chamber 130 to establish a labyrinth type air flow pattern therein. A primary air charge hole 136 extends through side pad section 108A to permit ambient air to communicate with primary side bellows chamber 130. A fifth primary air bridge channel 138 provides fluid communication between primary side bellows chamber 130 of side pad section 108A and a primary side bellows chamber 140 associated with side pad section 108B. A pair of elongated baffle projections 141 extend downwardly into primary side bellows chamber 140 to establish a labyrinth type air flow pattern therein. A primary air charge hole 142 extends through side pad section 108B to permit ambient air to communicate with primary side bellows chamber 140. A sixth primary air bridge channel 144 provides fluid communication between primary side bellows chamber 140 of side pad section 108B and a primary side bellows chamber 146 associated with side pad section 108C. A pair of elongated baffle projections 147 extend downwardly into primary side bellows chamber 146 to establish a labyrinth type air flow pattern therein. A primary air charge hole 148 extend through side pad section 108C to permit ambient air to communicate with primary side bellows chamber 146.

A seventh primary air bridge channel 150 provides fluid communication between primary side bellows chamber 146 of side pad section 108C and primary side bellows chamber 120 associated with side pad section 108D. A pair of elongated baffle projections 153 extend downwardly into primary side bellows chamber 120 to establish a labyrinth type air flow pattern therein. A primary air charge hole 154 extends through side pad section 108D to permit ambient air to communicate with primary side bellows chamber 120.

As previously disclosed, primary side bellows chamber 124 of side pad section 108H is in fluid communication with primary crown bellows chamber 114 of crown pad section 104 via second primary air bridge channel 122 and is also in fluid communication with primary front bellows chamber 126 of front pad section 106 via fourth primary air bridge channel 132. Primary side bellows chamber 124 of side pad section 108H is also in fluid communication with a primary side bellows chamber 156 associated with side pad section 108G via an eighth primary air bridge channel 158. A pair of elongated baffle projections 159 extend downwardly into primary side bellows chamber 156 so as to establish a labyrinth type air flow pattern therein. A primary air charge hole 160 extends through side pad section 108G to permit ambient air to communicate with primary side bellows chamber 156.

A ninth primary air bridge channel 162 provides fluid communication between primary side bellows chamber 156 of side pad section 108G and a primary side bellows chamber 164 associated with side pad section 108F. A pair of elongated baffle projections 165 extend into primary side bellows chamber 164 and establish a labyrinth type air flow pattern therein. A primary air charge hole 166 extends through side pad section 108F to permit ambient air to communicate with side bellows chamber 164. A tenth primary air bridge channel 168 provides fluid communication between primary side bellows chamber 164 of side pad sections 108F and a primary side bellows chamber 170 associated with side pad section 108E. Baffle projections 169 extend into side bellows chamber 170 to establish a labyrinth type air flow pattern therein. A primary air charge hole 172 extends through side pad sections 108E to permit ambient air to communicate with primary side bellows chamber 170.

Right ear pad section 110A of primary bellows unit 100 defines a primary ear bellows chamber 174 having one or more elongated baffle projections 175 for establishing a labyrinth type air flow pattern therein. Primary ear bellows chamber 174 is in fluid communication with primary side bellows chamber 140 of side pad section 108B via an eleventh primary air bridge channel 176. A primary air charge hole 177 extends through ear pad section 110A to permit ambient air to communicate with primary ear bellows chamber 174. Similarly, left ear pad section 110B of primary bellows unit 100 defines a primary ear bellows chamber 178 having one or more elongated baffle projections 179 for establishing a labyrinth type air flow pattern therein. Primary ear bellows chamber 178 is in fluid communication with side bellows chamber 156 of side pad section 108G via a twelfth primary air bridge channel 180. A primary air charge hole 181 extends through ear pad section 110B to permit ambient air to communicate with primary ear bellows chamber 178.

Upon assembly of CAD assembly 14 into outer shell 12, back pad sections 112A-112D of primary bellows unit 100 are aligned and position adjacent to a back region of inner surface 20 of outer shell 12. Upper back pad sections 112A and 112C are located above lower back pad sections 112B and 112D, respectively. Upper back pad section 112A defines a first primary upper back bellows chamber 182 that is in fluid communication with side bellows chamber 120 of side pad section 108D via a thirteenth primary air bridge channel 184. A pair of transversely oriented elongated baffle projections 185 extend into first primary upper back bellows chamber 182 and are arranged to establish a non-laminar air flow pattern therein. A primary air charge hole 186 extends through upper back pad section 112A to permit ambient air to communicate with first primary upper back bellows chamber 182. First primary upper back bellows chamber 182 of upper back pad section 112A is in fluid communication with a first primary lower back bellows chamber 188 associated with lower back pad section 112B via a fourteenth air bridge channel 190. A pair of transversely oriented elongated baffle projections 191 extend into first primary lower back bellows chamber 188 and are arranged to establish a non-laminar air flow pattern therein. A primary air charge hole 192 extends through lower back pad section 112B to permit ambient air to communicate with first primary lower back bellows chamber 188.

Similarly, upper back pad section 112C defines a second primary upper back bellows chamber 194 that is in fluid communication with primary side bellows chamber 170 of side pad section 108E via a fifteenth air bridge channel 195. A pair of transversely oriented elongated baffle projections 193 extend into second primary upper back bellows chamber 194 and are arranged to establish a non-laminar flow pattern therein. A primary air charge hole 196 extends through upper back pad section 112C to permit ambient air to communicate with second primary upper back bellows chamber 194. Second primary upper back bellows chamber 194 of upper back pad section 112C is in fluid communication with a second primary lower back bellows chamber 198 associated with lower back pad section 112D via a sixteenth air bridge channel 197. A pair of transversely oriented elongated baffle projections 199 are arranged to establish a non-laminar air flow pattern within second primary lower back bellows chamber 198. A primary air charge hole 187 extends through lower back pad section 112D to permit ambient air to communicate with second primary lower back bellows chamber 198.

As described above, primary bellows unit 100 of CAD assembly 14 includes a plurality of primary bellows chambers that are each in fluid communication with at least one other primary bellows chamber via a primary air bridge channel. When base section 102 is attached to outer surface 302 of inner shell liner 300, the primary bellows chambers and the primary air bridge channel cooperate to define a continuous primary air flow circuit. While each of the primary air charge holes is noted to facilitate transfer of ambient air into and out of each of the primary bellows chamber, they also function to permit the release of moisture or condensation therefrom. It will be noted that a plurality of cut-outs 103 are formed in base section 102 of primary bellows unit 100 between first stage crown pad section 104 and first stage side pad sections 108A-108H to provide mass reduction and facilitate improved ventilation. These cut-outs 103 are matched in size and configuration to similar cut-outs 303 formed in inner shell liner 300 and cut-out 203 formed in secondary bellows unit 200. Additional cut-outs may be provided between the ear pad sections and the lower back pad sections if desired.

Secondary bellows unit 200 of CAD assembly 14 is generally shown to include a plurality of second stage pad sections extending from a secondary base section 202 that, in turn, is secured in an air-tight manner to an inner surface 308 of inner shell liner 300. Since the second stage pad sections are filled with non-pressurized ambient air, they are configured to deflect in response to an impact load applied by the head of the helmet wearer. It is contemplated that secondary bellows unit 200 can be a one-piece molded component formed from a suitably semi-rigid, yet resilient material. One suitable material may include TPE.

The second stage pad sections can be grouped into distinct sections associated with base section 202. Specifically, the second stage pad sections may include at least one crown pad section 204, at least one front pad section 206, a plurality of peripheral side pad sections 208A-208H, a pair of ear pad sections 210A, 210B, and a plurality of rear pad sections 212A-212D. FIGS. 2 and 3 illustrate the second stage pad sections mentioned above extending inwardly from secondary base section 202. FIGS. 12 through 16 illustrate these second stage pad sections, some shown in a generally translucent manner, to better define and show one or more internal baffle projections that are formed in each of the corresponding secondary bellows chambers. In a preferred arrangement, the second pad sections are mirror-image versions of the first pad sections so as to be symmetrical relative to a plane through inner shell liner 300.

Upon assembly of CAD assembly 14 into outer shell 12, second stage crown pad section 204 will be located at a crown region of the helmet wearer's head and is generally configured to be arcuate and define a generally cylindrical secondary crown bellows chamber 214. Secondary crown bellows chamber 214 is shown to include cross-shaped baffle projections 215 extending upwardly therefrom and which projects toward inner surface 308 of inner shell liner 300. Cross-shaped baffle 215 generally segregates secondary crown bellows chamber 214 into quadrants and facilitates a radially outward and centrifugal air flow pattern therein. A pair of secondary air charge holes 216 extend through crown pad section 204 to permit ambient air to communicate with secondary crown bellows chamber 214.

A first secondary air bridge channel 218 is shown to interconnect secondary crown bellows chamber 214 for fluid communication with a secondary side bellows chamber 220 associated with side pad section 208D while a second primary air bridge channel 222 is shown to interconnect secondary crown bellows chamber 214 for fluid communication with a secondary side bellows chamber 224 associated with side pad section 208H. Each of the secondary air bridge channels described hereinafter is configured as a tubular air flow passage extending from base section 202.

Upon installation of CAD assembly 14 within outer shell 12, second stage front pad section 206 of secondary bellows unit 200 is oriented to be located at a forward region of helmet 10 and defines a secondary front bellows chamber 226. A plurality of elongated baffle projections 227 extend into secondary front bellows chamber 226 to form a labyrinth type air flow pattern therein. A third secondary air bridge channel 228 is shown to provide fluid communication between secondary front bellows chamber 226 of front pad section 206 and a secondary side bellows chamber 230 associated with side pad section 208A. Likewise a fourth secondary air bridge channel 232 provides fluid communication between secondary front bellows chamber 226 of front pad section 206 and secondary side bellows chamber 224 of side pad section 208H. A secondary air charge hole 234 extends through front pad section 206 to permit ambient air to communicate with secondary front bellows chamber 226.

As noted, side pad section 208A defines secondary side bellows chamber 230. A pair of elongated baffle projections 235 extend into secondary side bellows chamber 230 to establish a labyrinth type air flow pattern therein. A secondary air charge hole 236 extends through side pad section 208A to permit ambient air to communicate with secondary side bellows chamber 230. A fifth secondary air bridge channel 238 provides fluid communication between secondary side bellows chamber 230 of side pad section 208A and a secondary side bellows chamber 240 associated with side pad section 208B. A pair of elongated baffle projections 241 extend into secondary side bellows chamber 240 to establish a labyrinth type air flow pattern therein. A secondary air charge hole 242 extends through side pad section 208B to permit ambient air to communicate with secondary side bellows chamber 240. A sixth secondary air bridge channel 244 provides fluid communication between secondary side bellows chamber 240 of side pad section 208B and a secondary side bellows chamber 246 associated with side pad section 208C. A pair of elongated baffle projections 247 extend into secondary side bellows chamber 246 to establish a labyrinth type air flow pattern therein. A secondary air charge hole 248 extends through side pad section 208C to permit ambient air to communicate with secondary side bellows chamber 246.

A seventh secondary air bridge channel 250 provides fluid communication between secondary side bellows chamber 246 of side pad section 208C and secondary side bellows chamber 220 associated with side pad section 208D. A pair of elongated baffle projections 253 extend into secondary side bellows chamber 220 to establish a labyrinth type air flow pattern therein. A secondary air charge hole 254 extends through side pad section 208D to permit ambient air to communicate with secondary side bellows chamber 220.

As previously disclosed, secondary side bellows chamber 224 of side pad section 208H is in fluid communication with secondary crown bellows chamber 214 of crown pad section 204 via second secondary air bridge channel 222 and is also in fluid communication with secondary front bellows chamber 226 of front pad section 206 via fourth secondary air bridge channel 232. Secondary side bellows chamber 224 of side pad section 208H is also in fluid communication with a secondary side bellows chamber 256 associated with side pad section 208G via an eighth secondary air bridge channel 258. A pair of elongated baffle projections 259 extend into secondary side bellows chamber 256 so as to establish a labyrinth type air flow pattern therein. A secondary air charge hole 260 extends through side pad section 208G to permit ambient air to communicate with secondary side bellows chamber 256.

A ninth secondary air bridge channel 262 provides fluid communication between secondary side bellows chamber 256 of side pad section 208G and a secondary side bellows chamber 264 associated with side pad section 208F. A pair of elongated baffle projections 265 extend into secondary side bellows chamber 264 and establish a labyrinth type air flow pattern therein. A secondary air charge hole 266 extends through side pad section 108F to permit ambient air to communicate with secondary side bellows chamber 264. A tenth primary air bridge channel 268 provides fluid communication between secondary side bellows chamber 264 of side pad section 208F and a secondary side bellows chamber 270 associated with side pad section 208E. Baffle projections 269 extend into secondary side bellows chamber 270 to establish a labyrinth type air flow pattern therein. A secondary air charge hole 272 extends through side pad section 208E to permit ambient air to communicate with secondary side bellows chamber 270.

Right ear pad section 210A of secondary bellows unit 200 defines a secondary ear bellows chamber 274 having one or more elongated baffle projections 275 for establishing a labyrinth type air flow pattern therein. Secondary ear bellows chamber 274 of ear pad section 210A is in fluid communication with secondary side bellows chamber 240 of side pad section 208B via an eleventh air bridge channel 276. A secondary air charge hole 272 extends through ear pad section 210A to permit ambient air to communicate with secondary ear bellows chamber 274. Similarly, left ear pad section 210B of secondary bellows unit 200 defines a secondary ear bellows chamber 278 having one or more elongated baffle projections 279 for establishing a labyrinth type air flow pattern therein. Secondary ear bellows chamber 278 of left ear pad section 210B is in fluid communication with secondary side bellows chamber 256 of side pad section 208G via a twelfth air bridge channel 280. A secondary air charge hole 281 extends through ear pad section 210B to permit ambient air to communicate with secondary ear bellows chamber 178.

Upon assembly of CAD assembly 14 into outer shell 12, back pad sections 212A-212D of secondary bellows unit 200 are aligned and positioned adjacent to a back region of helmet 10. Upper back pad sections 212A and 212C are located above lower back pad sections 212B and 212D, respectively. Upper back pad section 212A defines a first secondary upper back bellows chamber 282 that is in fluid communication with secondary side bellows chamber 220 of side pad section 208D via a thirteenth air bridge channel 284. A pair of transversely oriented elongated baffle projections 285 extend into first secondary upper back bellows chamber 282 and are arranged to establish a non-laminar air flow pattern therein. A secondary air charge hole 286 extends through upper back pad section 212A to permit ambient air to communicate with first secondary upper back bellows chamber 282. First secondary upper back bellows chamber 282 of upper back pad section 212A is in fluid communication with a first secondary lower back bellows chamber 288 associated with back pad section 212B via a fourteenth air bridge channel 290. A pair of transversely oriented elongated baffle projections 291 extend into first secondary lower back bellows chamber 288 and are arranged to establish a non-laminar air flow pattern therein. A secondary air charge hole 292 extends through lower back pad section 212B to permit ambient air to communicate with first secondary lower back bellows chamber 288.

Similarly, upper back pad section 212C defines a second secondary upper back bellows chamber 294 that is in fluid communication with secondary side bellows chamber 270 of side pad section 208E via a fifteenth air bridge channel 295. A pair of transversely oriented elongated baffle projections 293 extend into second secondary upper back bellows chamber 294 and are arranged to establish a non-laminar flow pattern therein. A secondary air charge hole 296 extends through upper back pad section 212C to permit ambient air to communicate with second secondary upper back bellows chamber 294. Second secondary upper back bellows chamber 294 of upper back pad section 212C is in fluid communication with a second secondary lower back bellows chamber 298 associated with lower back pad section 212D via a sixteenth air bridge channel 297. A pair of transversely oriented elongated baffle projections 299 are arranged to establish a non-laminar air flow pattern within second secondary lower back bellows chamber 298. A secondary air charge hole 287 extends through lower back pad section 212D to permit ambient air to communicate with second secondary lower back bellows chamber 298.

As described above, secondary bellows unit 200 of CAD assembly 14 includes a plurality of secondary bellows chambers that are each in fluid communication with at least one other secondary bellows chamber via a secondary air bridge channel. When base section 202 is attached to inner surface 308 of inner shell liner 300, the secondary bellows chamber and the secondary air bridge channels define a continuous secondary air flow circuit. While each of the secondary air charge holes is noted to facilitate transfer of ambient air into and out of each of the secondary bellows chambers, they also function to permit the release of moisture or condensation therefrom.

As noted, each of the primary bellows chambers is in fluid communication with a corresponding one of the secondary bellows chambers via an air transfer hole extending through the inner shell liner. FIGS. 6, 7, 11, 13 and 14 illustrate many of these air transfer holes. Air transfer holes 310 provide fluid communication between the aligned primary crown bellows chamber and the secondary crown bellows chamber. Similarly, air transfer holes 312 provide fluid communication between aligned sets of the primary side bellows chambers and secondary side bellows chambers. Air transfer holes 314A, 314B provide fluid communication between the upper and lower sets of primary back and secondary back bellows chambers, respectively. Finally, air transfer holes 316 provide fluid communication between the aligned primary ear bellows chambers and secondary ear bellows chambers. Inner shell liner 300 is preferably made of a material having sufficient rigidity to support primary bellows unit 100 and secondary bellows unit 200, and yet have a hardness less than outer shell 12. One suitable material for inner shell 300 is a more dense or stiffer blend of the same material used for the bellows units (i.e., TPE or TPU). Most importantly, inner shell 300 must be more rigid than the stage one and stage two pad sections so as to permit a plurality of pad sections to compress at a time and spread the energy over a larger area.

Figure 5:
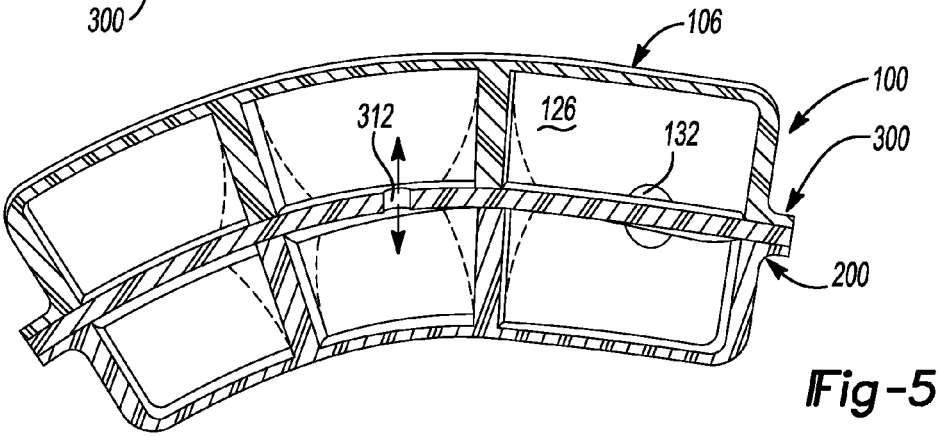
FIG. 5 is a sectional view taken generally along line A-A of FIG. 4.
Figure 6:
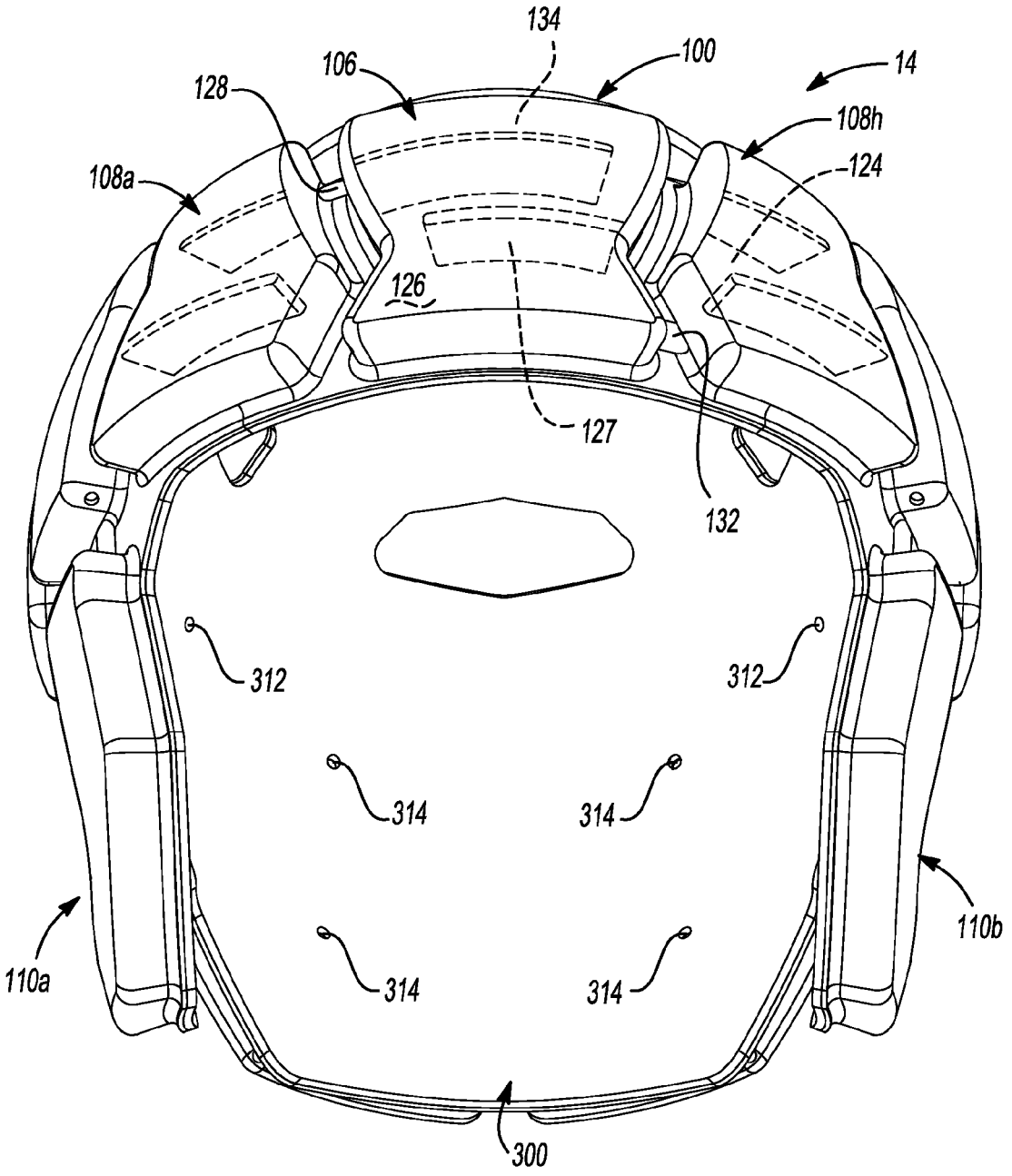
FIG. 6 is generally similar to FIG. 4 except that the secondary bellows unit has been removed for purposes of additional clarity regarding various features of the CAD assembly.
Figure 7:
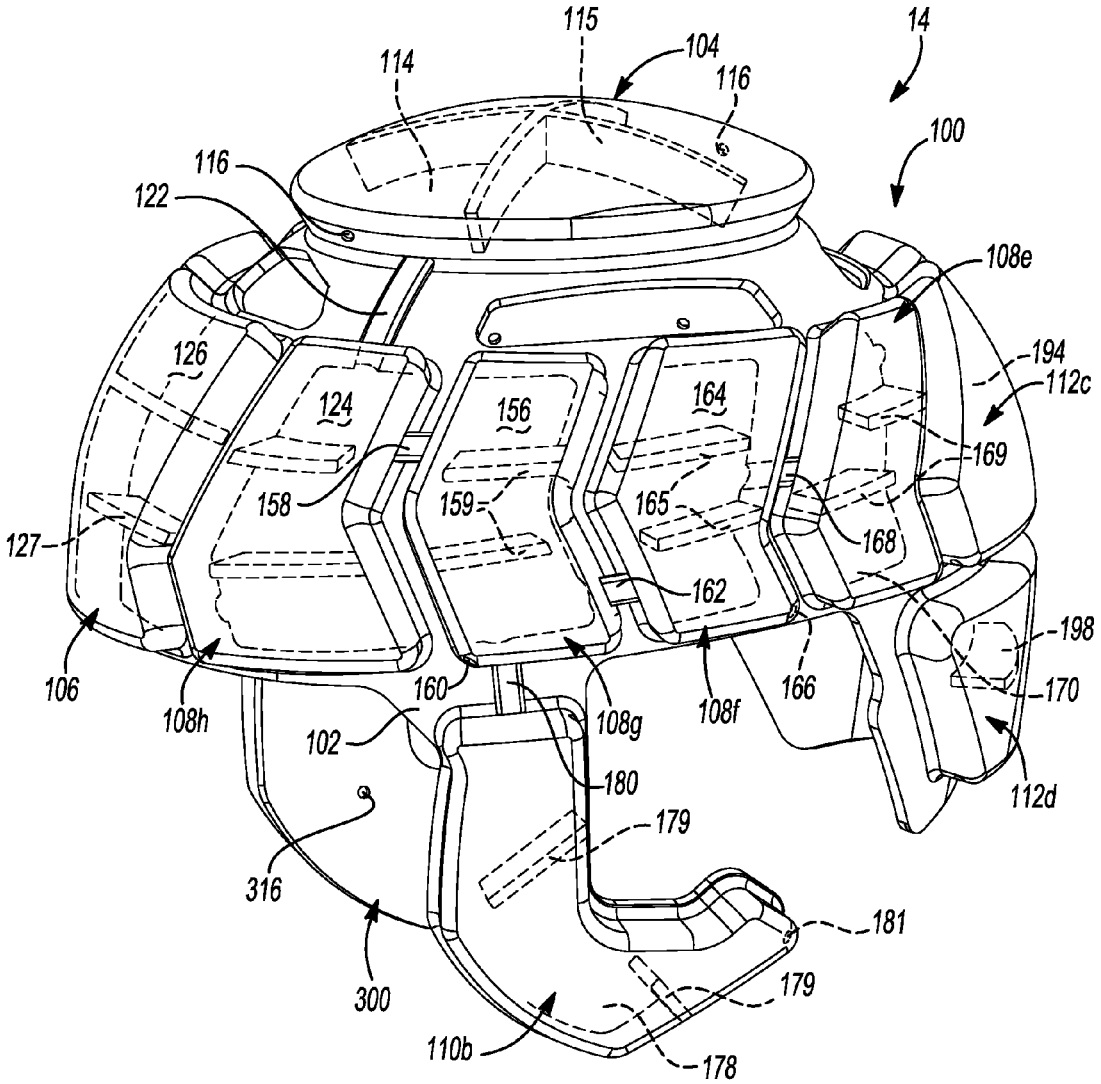
FIG. 7 is a side isometric view of the CAD assembly shown in FIG. 6.
Figure 8:
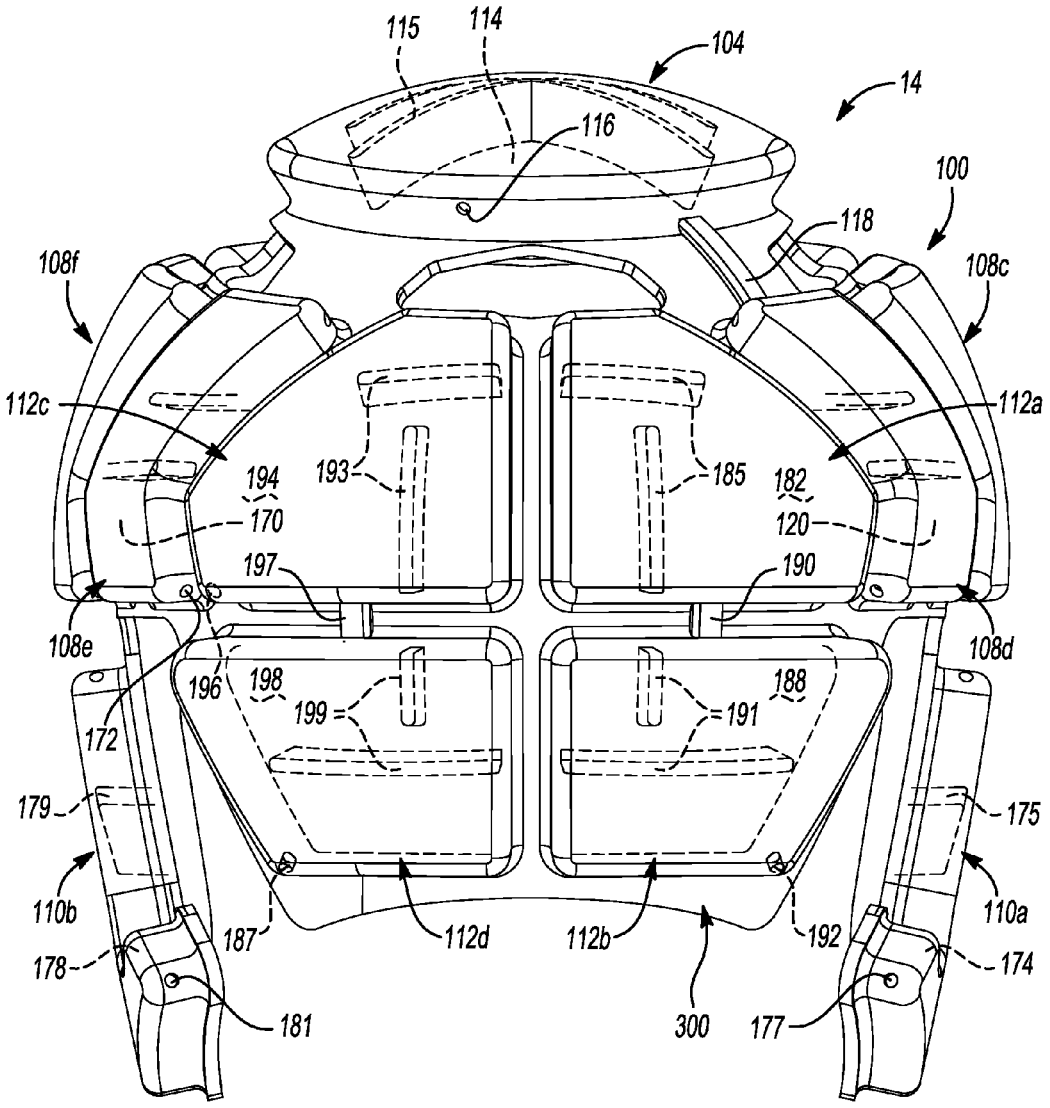
FIG. 8 is a rear isometric view of the CAD assembly shown in FIGS. 6 and 7.
Figure 9:
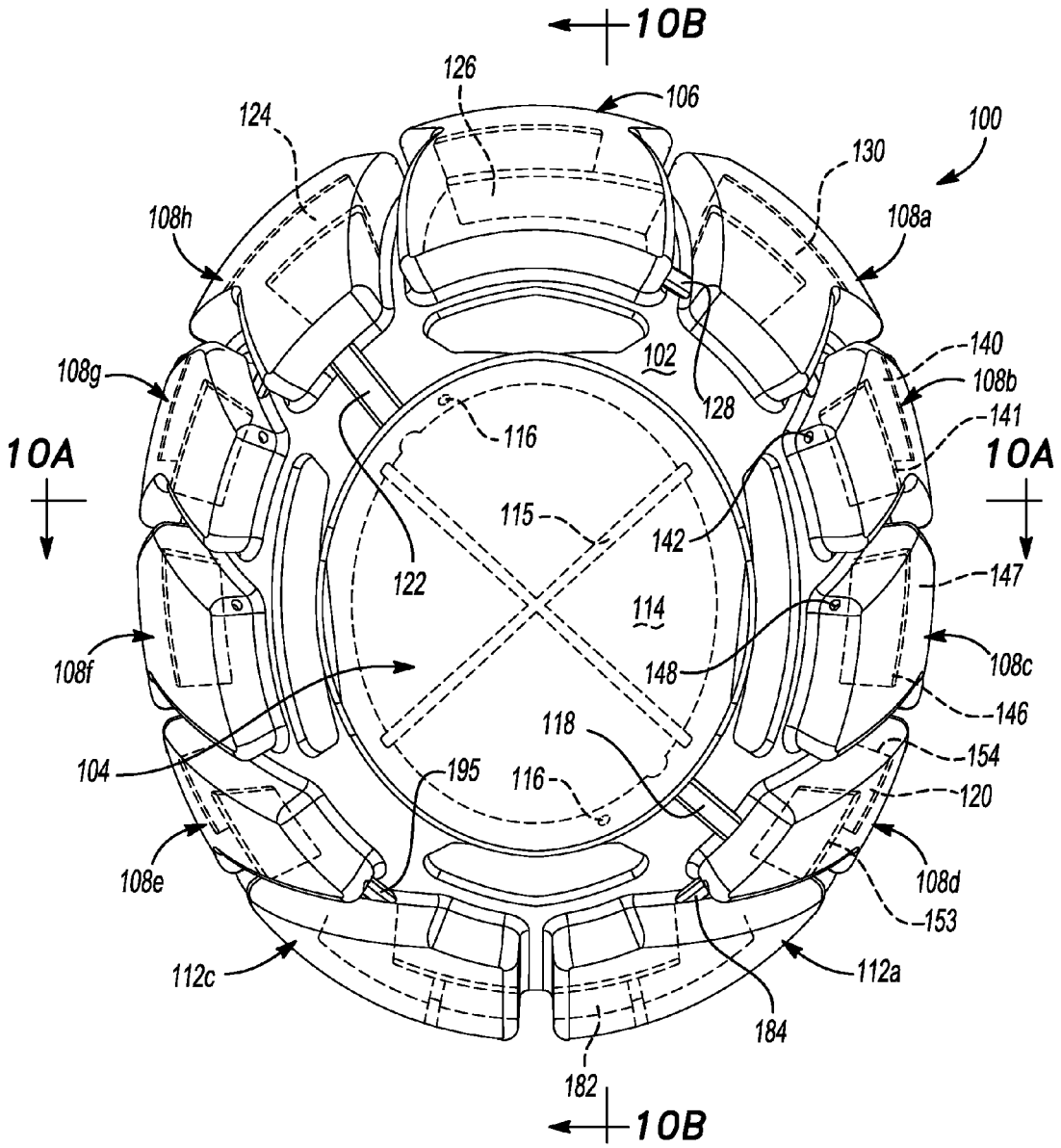
FIG. 9 is a top isometric view of the CAD assembly shown in FIGS. 6 through 8.
Figure 10A:
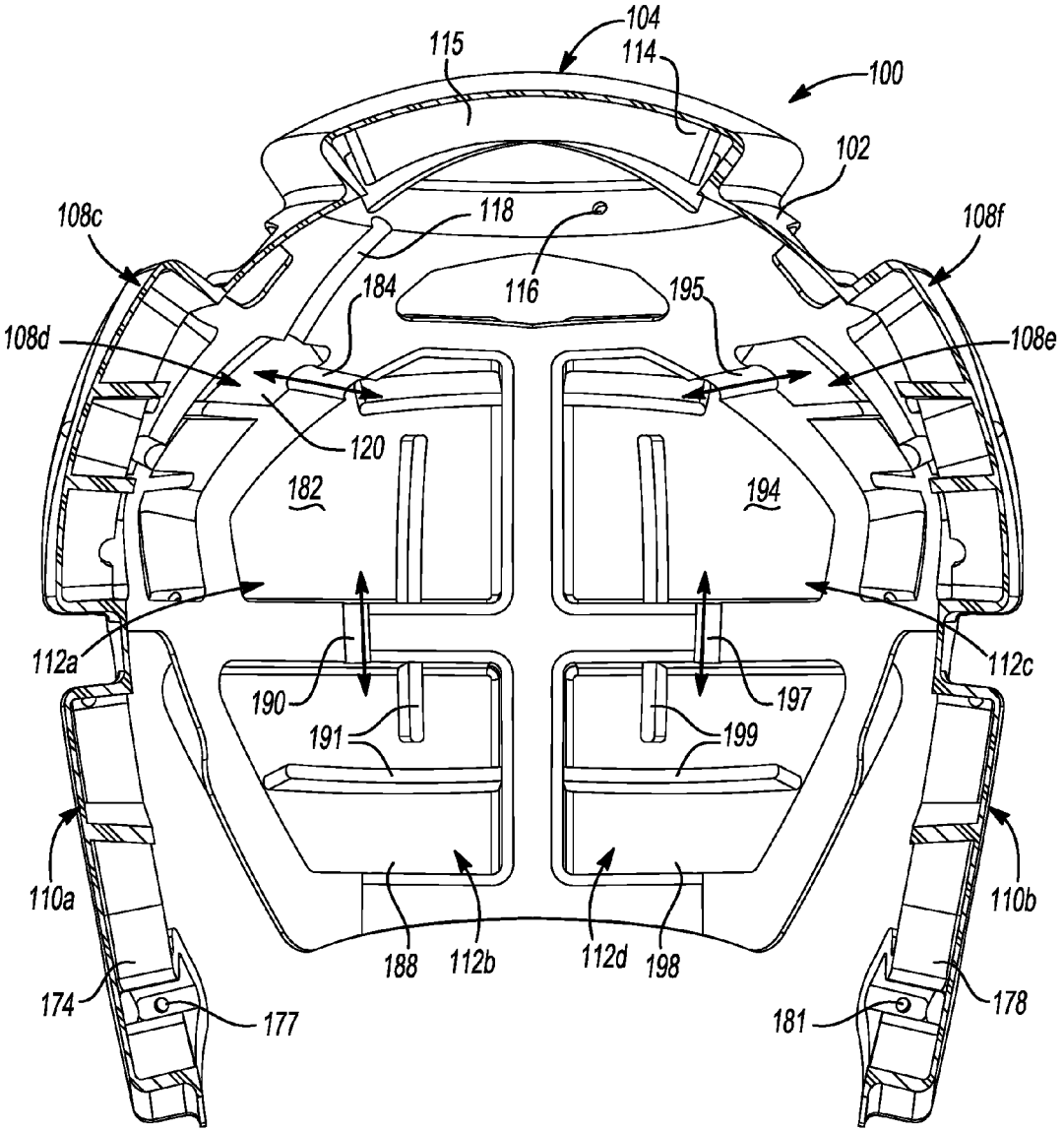
FIGS. 10A and 10B are vertical sectional views of the primary bellows unit associated with the CAD assembly of the present disclosure.
Figure 10B:
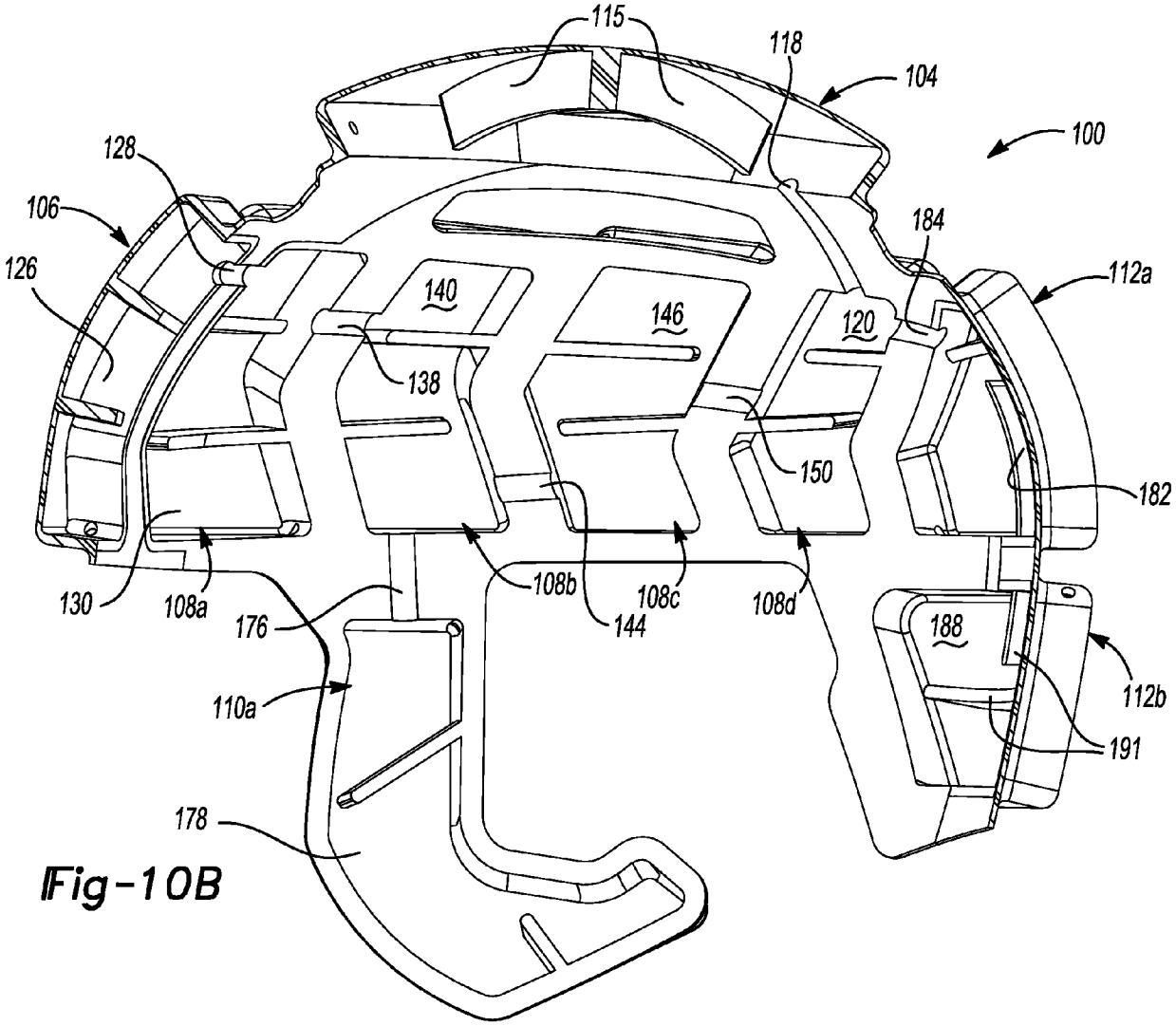
Figure 11A:
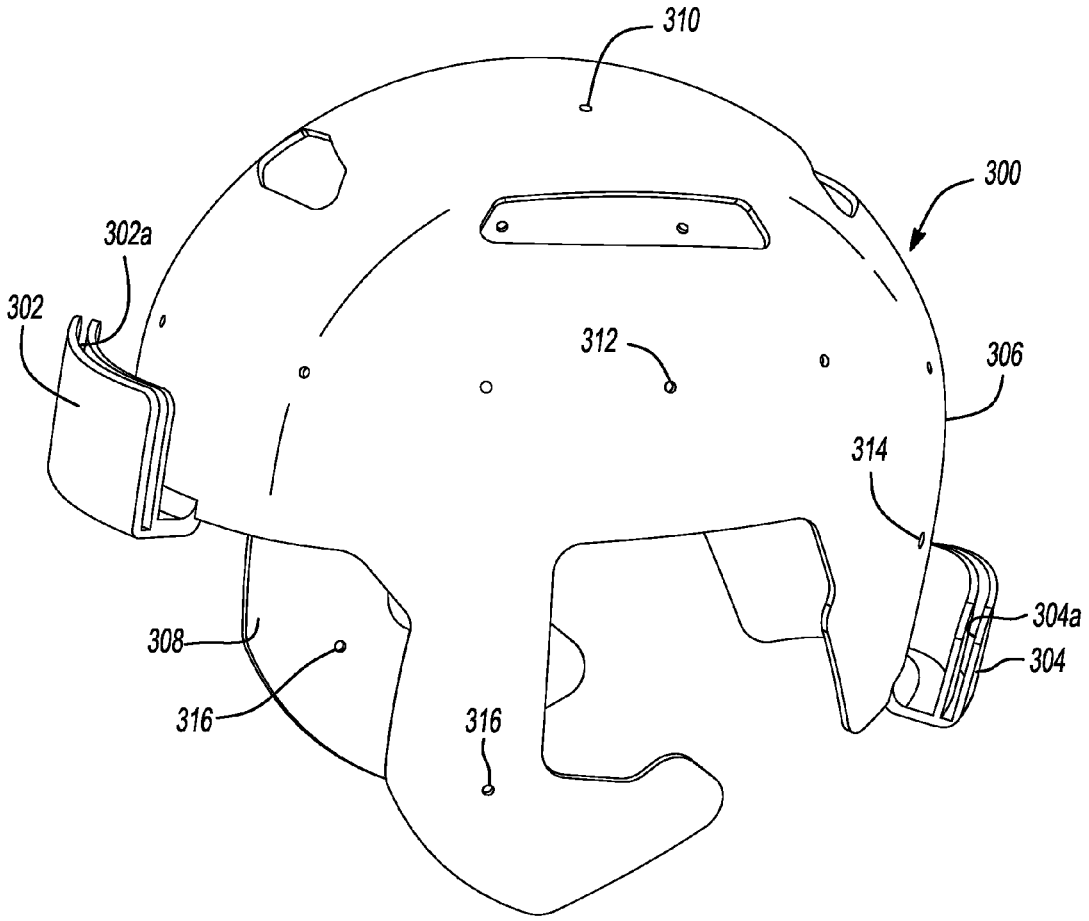
FIGS. 11A and 11B are views of the inner shell liner associated with the CAD assembly of the present disclosure.
Figure 11B:
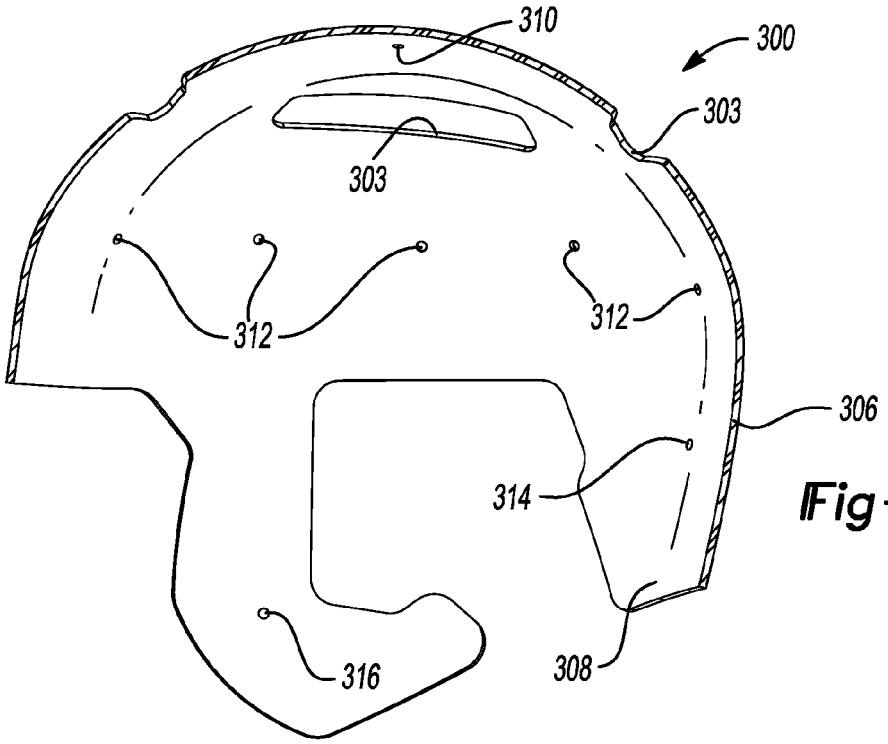
Figure 12:
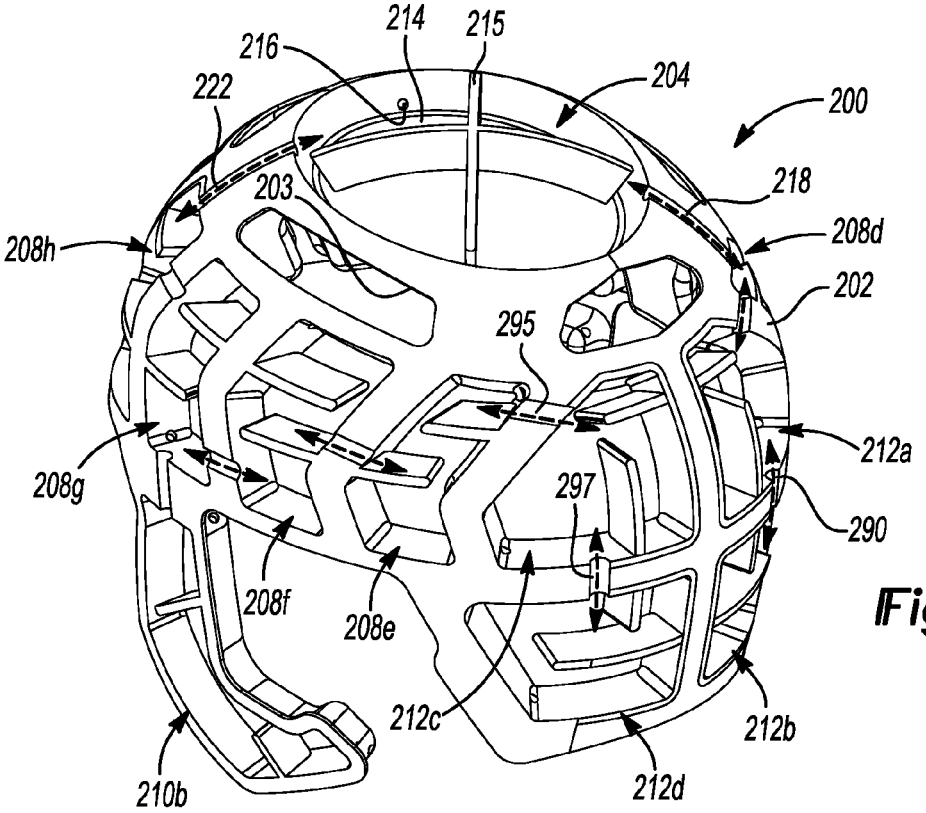
FIG. 12 is an isometric view of the secondary bellows unit associated with the CAD assembly of the present disclosure.
Figure 13:
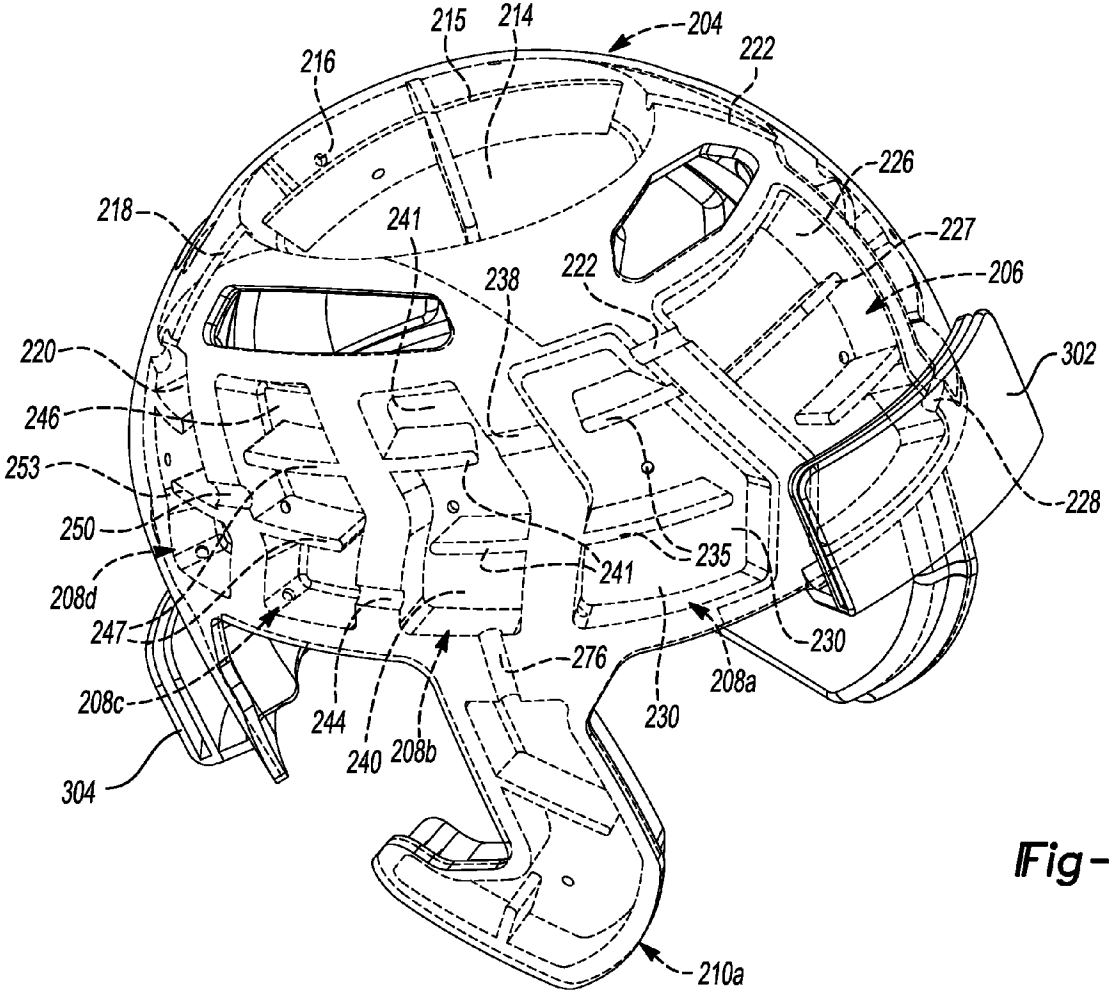
FIG. 13 is a side isometric view of the secondary bellows unit installed in the inner shell liner, which is shown in phantom for improved clarity of the illustration.
Figure 14:
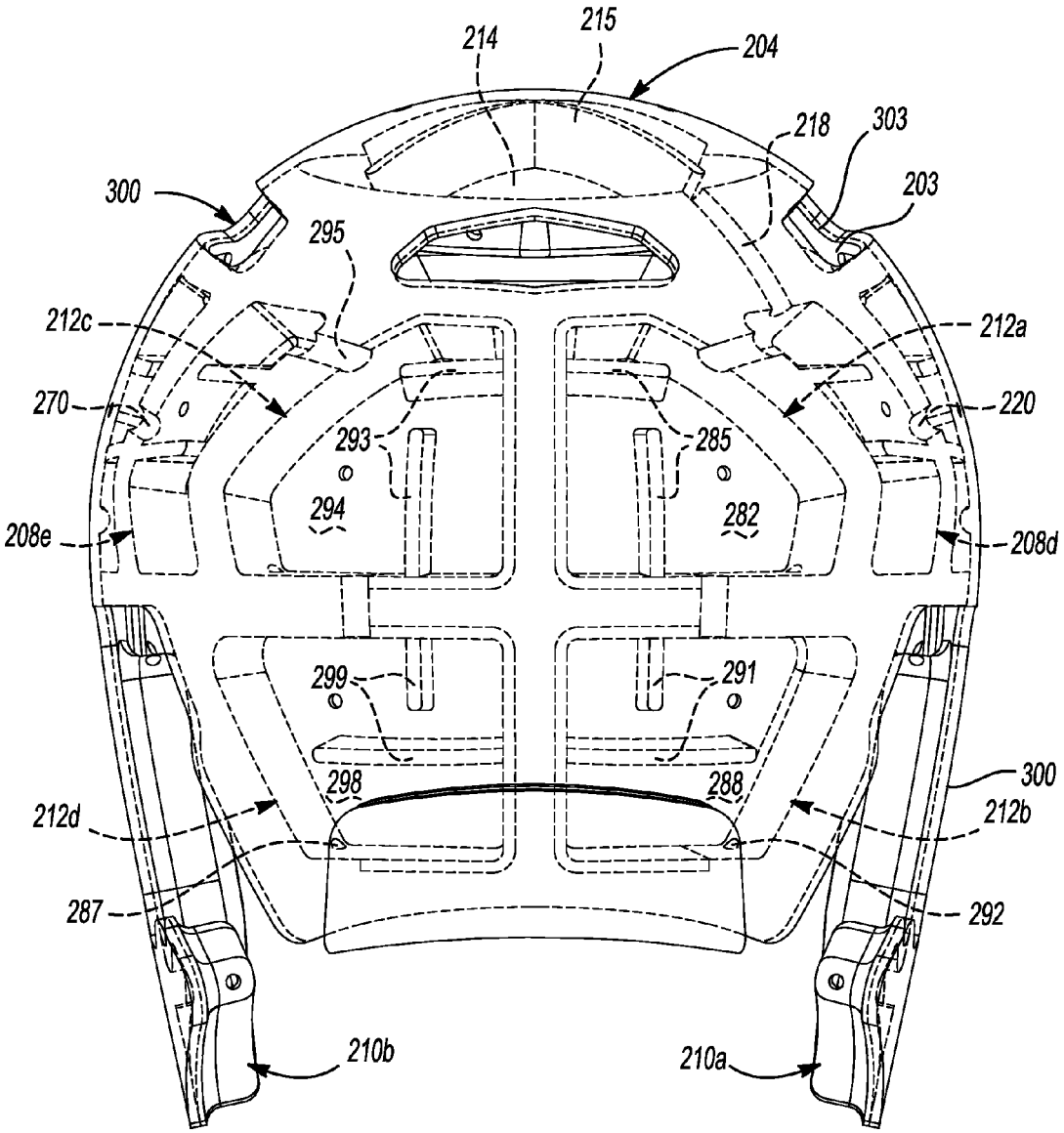
FIG. 14 is a rear isometric view of the secondary bellows unit and inner shell liner shown in FIG. 13.
Figure 15:
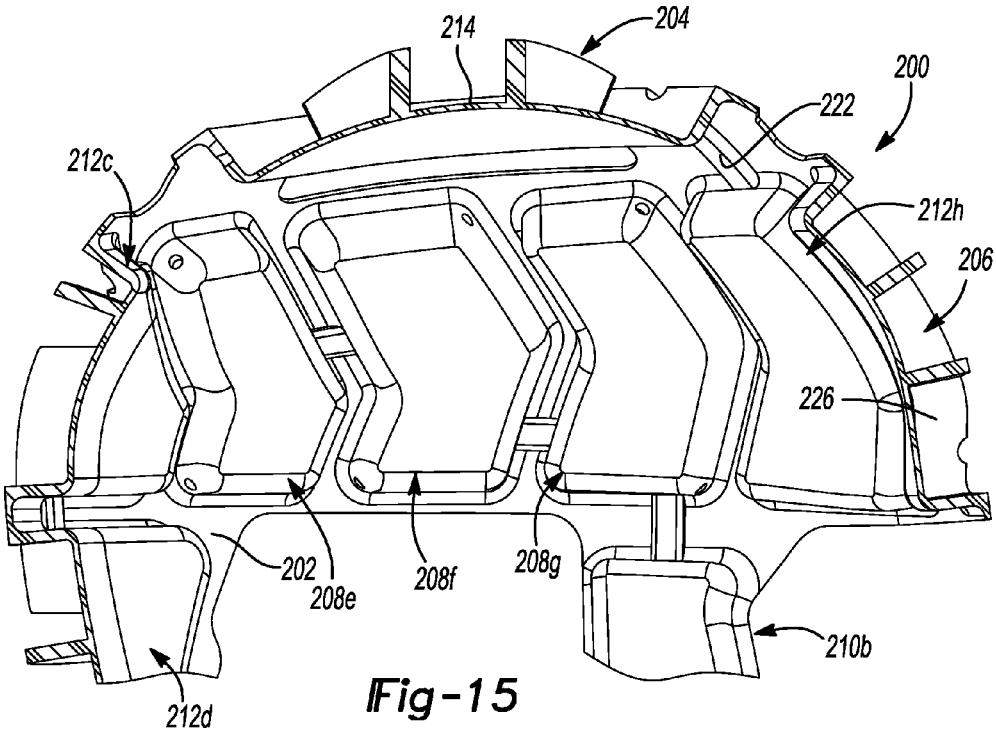
FIG. 15 is a sectional view taken through a portion of the secondary bellows unit.
Figure 16:
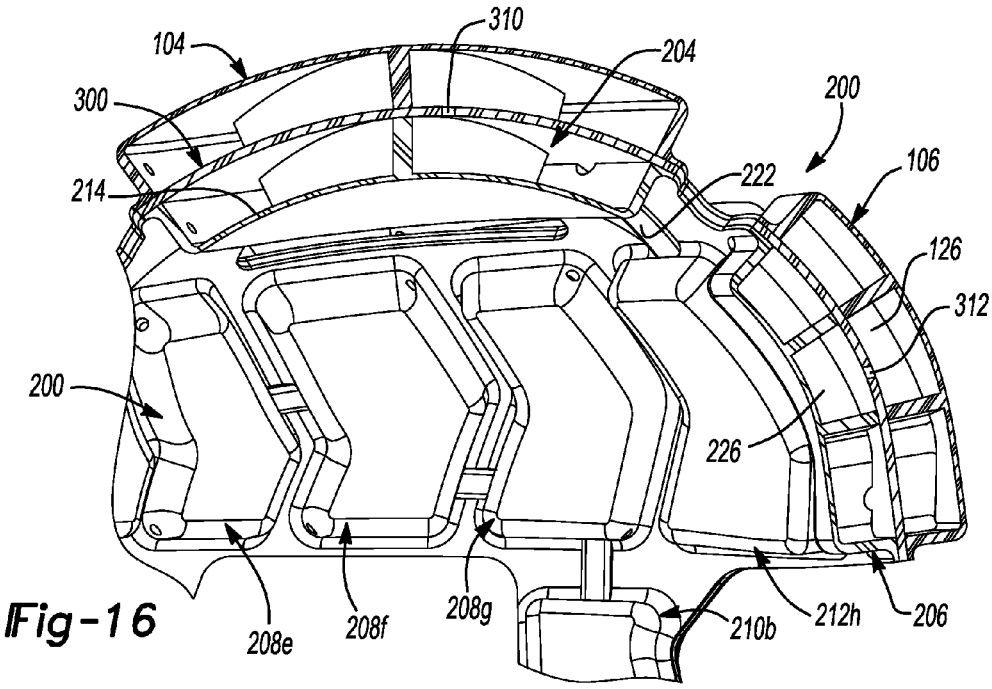
FIG. 16 is a sectional view taken through a portion of the CAD assembly.

Referring to FIG. 5, baffle projections 127 associated with first stage front pad section 106 and baffle projections 227 associate with second stage front pad section 206 are shown to have a generally common "thickness" dimension across their entire height and length. While such common or "straight" baffle projections are acceptable, it has been determined that use of "variable" thickness projections may be useful in controlling the deflection characteristic of the first and second stage pad sections. Accordingly, FIG. 5 illustrates tapered thickness profiles (in phantom) of baffles 127 and 227. Specifically, baffles 127, 227 have a greater thickness dimension near their interface with outer shell liner 300. Such a tapered configuration may permit the pad sections to start collapsing at the surfaces engaging outer shell 10 and the wearer's head, while resisting/attenuating the linear and rotational impact forces.

According to the present disclosure, CAD assembly 14 provides a first stage air transfer and energy dissipation mechanism in association with primary bellows unit 100 as well as a second stage air transfer and energy dissipation mechanism in association with secondary bellows unit 200. In this regard, the primary air flow circuit of primary bellows unit 100 and the secondary air flow circuit of secondary bellows unit 200 facilitate this dual stage air transfer and energy dissipation system. The first and second air flow circuits are interconnected via the air transfer holes in the inner shell liner. Those skilled in the art will appreciate that the specific number, arrangement, size and configuration of the first stage pads (and corresponding primary bellows chambers) and specific number, arrangement, size and configuration of the second stage pads (and corresponding secondary bellows chambers) shown are merely intended to be exemplary in nature. Likewise, the size and air flow characteristics associated with the air charge holes, the air bridge channels, and the air transfer holes can be selected to provide metered and controlled air transfer through CAD assembly 14 to assist in optimizing impact damping and energy dissipation.

In operation, compression of CAD assembly 14 occurs when the head of a wearer of protective helmet 10 encounters an impact which forces the head to move in relation to an angle of impact. This action results in resilient collapse of the pad sections and forces a resilient cushion of regulated and controlled ambient air to be transferred to adjacent bellows chambers, thereby distributing the impact force over a larger area so as to delay and dissipate the impact away from the head of the helmet wearer. CAD assembly 14 creates a multi-stage "time delayed" impact dissipation that is operable for continuously transferring air by filling and subsequently refilling the bellows chambers until the impact has been dispersed.

Figure 17B:
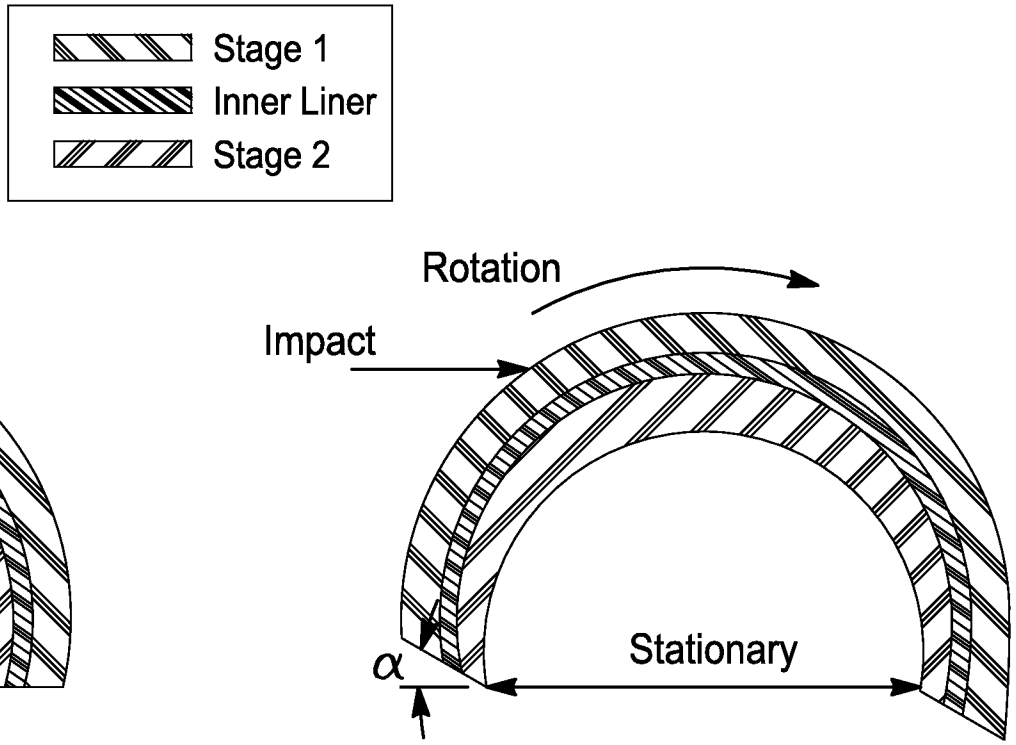
FIGS. 17A and 17B graphically illustrates action of the CAD assembly in response to a rotational acceleration condition.
Figure 17A:
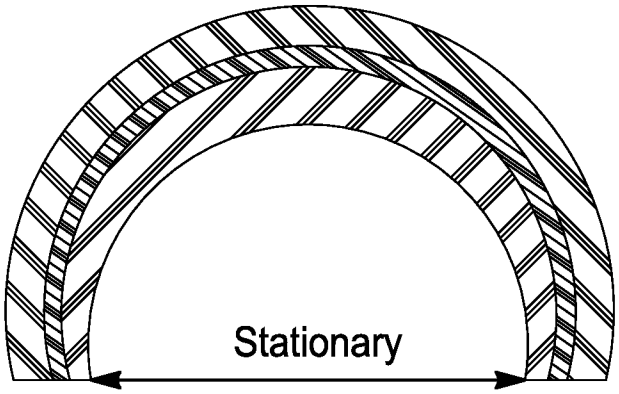

Referring to FIGS. 17A and 17B, the movement of CAD assembly 14 during, or in response to, a rotational force/acceleration impact exerted on protective helmet 10 is addressed. While linearly directed forces/accelerations of CAD assembly 14 are addressed above, the present disclosure provides a further benefit when helmet 10 is exposed to a rotational impact. Much like a boxer getting hit with a hook, the head of a person wearing helmet 10 can twist. Such rotational and centrifugal movement of the head within helmet 10 is minimized due to CAD assembly 14 providing a "suspended" function due to the elasticity of the stage one and stage two pad sections associated with outer bellows unit 100 and inner bellows unit 200 relative to inner shell liner 300. An example of angular movement of CAD assembly 14 relative to the wearer's head is shown by alpha "α" in FIG. 17B. Accordingly, compression of adjacent pad sections in concert with elastic deflection thereof, functions to limit the intensity of a rotational force exerted on outer shell 12 of helmet 10.

CAD assembly 14 can be a modular assembly that can be easily installed in, or removed from virtually any type of outer shell portion of a helmet. This modularity permits different impact damping characteristics to be established by simply selecting from one or more differently sized or configured primary bellows unit 100, secondary bellows units 200 and inner shell liners 300 to provide optimal comfort and address both adult and youth requirements.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. In a protective helmet adapted to be worn on the head of a person and having a rigid outer shell defining an interior chamber, a controlled air dissipation (CAD) assembly configured to be installed within the interior chamber of the outer shell, the CAD assembly comprising:

a liner having at least two air transfer holes;

a primary bellows unit mounted to an outer surface of said liner and extending toward an inner surface of the outer shell, said primary bellows unit including a primary base section mounted to said outer surface of said liner, at least two first stage pad sections extending from said primary base section with each defining a primary bellows chamber therein, and a first stage bridge section interconnecting adjacent first stage pad sections to define a primary air channel configured to facilitate air transfer between adjacent primary bellows chambers; and a secondary bellows unit mounted to an inner surface of said liner and extending toward the head of the person wearing the protective helmet, said secondary bellows unit including a secondary base section mounted to said inner surface of said liner, at least two second stage pad sections extending from said secondary base section with each defining a secondary bellows chamber therein, and a second stage bridge section interconnecting adjacent second stage pad sections to define a secondary air channel configured to facilitate air transfer between adjacent secondary bellows chambers;

wherein a first one of said air transfer holes in said liner is arranged to facilitate air transfer between a first pair of said primary and secondary bellows chambers, wherein a second one of said air transfer holes in said liner is arranged to facilitate air transfer between a second pair of said primary and secondary bellows chambers, and wherein at least one of said first and second stage pad sections associated with each of said first and second pairs of said primary and secondary bellows chambers includes an air charge hole to permit communication with ambient air.

2. The CAD assembly of claim 1 wherein each of said first stage pad sections includes a primary air charge hole to permit ambient air to communicate with a corresponding one of said primary bellows chambers.

3. The CAD assembly of claim 2 wherein each of said second stage pad sections includes a secondary air charge hole to permit ambient air to communicate with a corresponding one of said secondary bellows chambers.

4. The CAD assembly of claim 1 wherein said primary base section of said primary bellows unit is sealed relative to said outer surface of said liner to facilitate air transfer between adjacent primary bellows chambers in response to compression of one said first stage pad sections due to an impact force applied to said outer shell.

5. The CAD assembly of claim 4 wherein said secondary base section of said secondary bellows unit is sealed relative to said inner surface of said liner to facilitate air transfer between adjacent secondary bellows chambers in response to compression of one of said second stage pad sections due to an impact with the head of the person wearing the helmet.

6. The CAD assembly of claim 1 wherein said primary bellows chambers and said secondary bellows chambers are configured in a mirror-image arrangement such that each primary bellows chamber is in fluid communication with a similarly configured secondary bellows chamber via said air transfer hole extending through said liner.

7. The CAD assembly of claim 1 wherein said liner includes front and rear mounting flanges for releasably mounting said CAD assembly to said outer shell.

8. The CAD assembly of claim 1 wherein a primary baffle projection is formed inside said primary bellows chambers to facilitate directional flow therein during an air transfer event between adjacent primary bellows chambers.

9. The CAD assembly of claim 1 wherein said primary bellows unit is configured to define at least one of a primary crown bellows chamber, a primary front bellows chamber, a primary rear bellows chamber, a primary side bellows chamber, and a primary ear bellows chamber.

10. The CAD assembly of claim 9 wherein said primary crown bellows chamber is associated with a first stage crown pad section of said primary bellows unit that is generally aligned with a crown region of said outer shell.

11. The CAD assembly of claim 10 wherein said primary front bellows chamber is associated with a first stage front pad section that is generally aligned with a frontal region of said outer shell.

12. The CAD assembly of claim 11 wherein said primary rear bellows chamber is associated with a first stage rear pad section that is generally aligned with a rear region of said outer shell.

13. The CAD assembly of claim 12 wherein said primary side bellows chamber is associated with a first stage side pad section generally disposed below said first stage crown pad section and between said first stage front and rear pad sections, and wherein said primary ear bellows chamber is associated with a first stage ear pad section that is generally aligned with an ear region of said outer shell.

14. The CAD assembly of claim 13 wherein said secondary bellows unit is configured to define at least one of a secondary crown bellows chamber, a secondary front bellows chamber, a secondary rear bellows chamber, a secondary side bellows chamber, and a secondary ear bellows chamber.

15. The CAD assembly of claim 14 wherein said wherein said secondary crown bellows chamber is associated with a second stage crown pad section of said secondary bellows unit that is generally aligned with a crown region of the person's head, wherein said secondary front bellows chamber is associated with a second stage front pad section that is generally aligned with a frontal region of the person's head, wherein said secondary rear bellows chamber is associated with a second stage rear pad section that is generally aligned with a rear region of the person's head, wherein said secondary side bellows chamber is associated with a second stage side pad section generally disposed below said second stage crown pad section and between said second stage front and rear pad sections, and wherein said secondary ear bellows chamber is associated with a second stage ear pad section that is generally aligned with an ear region of the person's head.

16. The CAD assembly of claim 15 wherein a first primary air channel interconnects said primary crown bellows chamber to said primary front bellows chamber, wherein a second primary air channel interconnects said primary crown bellows chamber to said primary rear bellows chamber, wherein a third primary air channel interconnects said primary front bellows chamber to a primary side bellows chamber, and wherein a fourth primary air channel interconnects said primary rear bellows chamber to another one of said primary side bellows chambers.

17. In a protective helmet adapted to be worn on the head of a person and having a rigid outer shell defining an interior chamber, a controlled air dissipation (CAD) assembly configured to be installed within the interior chamber of the outer shell, the CAD assembly comprising:

first and second controlled air dissipation (CAD) sub-assemblies removeably installed within said interior chamber of said outer shell, each of said first and second CAD sub-assemblies including a primary bellows unit, a secondary bellows unit, and an inner liner disposed between said primary and secondary bellows units, said primary bellows unit being disposed between an outer surface of said inner liner and an inner surface of said outer shell and configured to include a plurality of first stage pad sections each defining a primary bellows chamber that is in fluid communication with at least one other primary bellows chamber and which is in communication with ambient air via a primary air charge hole, said secondary bellows unit being disposed between an inner surface of said inner liner and the head of the person wearing the helmet and configured to include a plurality of second stage pad sections each defining a secondary bellows chamber that is in fluid communication with at least one other secondary bellows chamber and which is in fluid communication with ambient air via a secondary air charge hole, said inner liner including a plurality of air transfer holes arranged to facilitate the transfer of air between a corresponding pair of primary and secondary bellows chambers;

a primary air channel interconnecting said primary bellows units of said first and second CAD sub-assemblies; and a secondary air channel interconnecting said secondary bellows units of said first and second CAD sub-assemblies.

18. In a protective helmet adapted to be worn on the head of a person and having a rigid outer shell defining an interior chamber, a controlled air dissipation (CAD) assembly configured to be installed within the interior chamber of the outer shell, the CAD assembly comprising:

first and second controlled air dissipation (CAD) sub-assemblies removeably installed within the interior chamber of the outer shell, each of said first and second CAD sub-assemblies including a primary bellows unit, a secondary bellows unit, and an inner liner disposed between said primary and secondary bellows units, each of said primary bellows units being disposed between an outer surface of said inner liner and an inner surface of the outer shell and configured to include at least two primary bellows chambers that are each in fluid communication with at least one other primary bellows chamber and which are in communication with ambient air via a primary air charge hole, each of said secondary bellows units being disposed between an inner surface of said inner liner and the head of the person wearing the helmet and configured to include at least two secondary bellows chambers that are each in fluid communication with at least one other secondary bellows chamber and which are in fluid communication with ambient air via a secondary air charge hole, said inner liner including at least two air transfer holes each arranged to facilitate the transfer of air between corresponding pairs of primary and secondary bellows chambers;

a primary air channel interconnecting said primary bellows units of said first and second CAD sub-assemblies to permit air transfer between a pair of corresponding primary bellows chambers; and a secondary air channel interconnecting said secondary bellows units of said first and second CAD sub-assemblies to permit air transfer between a pair of corresponding secondary bellows chambers.

* * * * *